US006336017B1

(12) United States Patent
Miyamoto et al.

(10) Patent No.: US 6,336,017 B1
(45) Date of Patent: Jan. 1, 2002

(54) MOUNTING MEMBER FOR MOUNTING A FLANGE TO AN END OF A CYLINDRICAL MEMBER OF AN ELECTROPHOTOGRAPHIC PHOTOSENSITIVE DRUM OF A PROCESS CARTRIDGE, SUCH A FLANGE, SUCH A DRUM, AND SUCH A PROCESS CARTRIDGE

(75) Inventors: Jun Miyamoto, Mishima; Shigeo Miyabe, Numazu; Takeshi Arimitsu, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/261,953

(22) Filed: Mar. 3, 1999

(30) Foreign Application Priority Data

Mar. 3, 1998 (JP) ..... 10-067893

(51) Int. Cl.[7] ..... G03G 15/00
(52) U.S. Cl. ..... 399/116; 399/117
(58) Field of Search ..... 399/117, 111, 399/116, 165, 167; 492/47

(56) References Cited

U.S. PATENT DOCUMENTS

| | | | | |
|---|---|---|---|---|
| 5,331,373 A | | 7/1994 | Nomura et al. | 355/200 |
| 5,452,056 A | | 9/1995 | Nomura et al. | 355/200 |
| 5,463,446 A | | 10/1995 | Watanabe et al. | 355/200 |
| 5,585,889 A | | 12/1996 | Shishido et al. | 355/200 |
| 5,599,265 A | * | 2/1997 | Foltz | 492/47 |
| 5,640,650 A | | 6/1997 | Watanabe et al. | 399/117 |
| 5,839,028 A | | 11/1998 | Nomura et al. | 399/109 |
| 5,845,173 A | * | 12/1998 | Zogg et al. | 399/117 |
| 5,873,012 A | | 2/1999 | Miyabe et al. | 399/90 |
| 5,878,309 A | | 3/1999 | Nomura et al. | 399/111 |
| 5,878,310 A | | 3/1999 | Noa et al. | 399/117 |
| 5,926,666 A | | 7/1999 | Miura et al. | 399/25 |
| 5,943,529 A | | 8/1999 | Miyabe et al. | 399/111 |
| 5,946,531 A | | 8/1999 | Miura et al. | 399/111 |
| 5,950,047 A | | 9/1999 | Miyabe et al. | 399/111 |
| 5,966,567 A | | 10/1999 | Matsuzaki et al. | 399/111 |

FOREIGN PATENT DOCUMENTS

| | | | | |
|---|---|---|---|---|
| EP | 0753800 A2 | | 1/1997 | G03G/21/18 |
| EP | 0775944 A1 | | 5/1997 | G03G/15/00 |
| EP | 0880081 A2 | | 11/1998 | G03G/15/99 |
| JP | 4-128849 | * | 4/1992 | |
| JP | 5-119682 | * | 5/1993 | |

OTHER PUBLICATIONS

Patent Abstracts of Japan vol. 099, No. 011, published Jan. 29, 1999, English abstract of Japanese Patent No. 10–282839.
Patent Abstracts of Japan vol. 017, No. 004, published Jan. 6, 1993, English abstract of Japanese Patent No. 04–237085.
Patent Abstracts of Japan vol. 018 No. 0387 published Jul. 20, 1994, English abstract of Japanese Patent No. 06–110361.
Patent Abstracts of Japan vol. 017, No. 485, published Sep. 2, 1993, English abstract of Japanese Patent No. 05–119681.

* cited by examiner

*Primary Examiner*—Quana M. Grainger
(74) *Attorney, Agent, or Firm*—Fitzpatrick, Cella, Harper & Scinto

(57) ABSTRACT

A mounting member for mounting a flange to an end of a cylindrical member of an electrophotographic photosensitive drum, includes a base plate; a hole provided at a center portion of said base plate; a plurality of first projected portions provided projected outwardly from an edge of the base plate, for elastic contact to an inner surface of the flange; and a plurality of second projected portions provided projected outwardly from an edge of the base plate, for elastic contact to an inner surface of the flange.

76 Claims, 17 Drawing Sheets

MOUNTING MEMBER FOR MOUNTING A FLANGE TO AN END OF A CYLINDRICAL MEMBER OF AN ELECTROPHOTOGRAPHIC PHOTOSENSITIVE DRUM OF A PROCESS CARTRIDGE, SUCH A FLANGE, SUCH A DRUM, AND SUCH A PROCESS CARTRIDGE

FIELD OF THE INVENTION AND RELATED ART:

The present invention relates to a mounting member, a drum flange, an electrophotographic photosensitive drum and a process cartridge.

Here, the term "electrophotographic image forming apparatus" refers to an apparatus which forms images on a recording medium, using an electrophotographic image forming process. It includes an electrophotographic copying machine, an electrophotographic printer (for example, LED printer, laser beam printer), an electrophotographic facsimile machine, an electrophotographic word processor, and the like.

The term "process cartridge" refers to a cartridge having, as a unit, an electrophotographic photosensitive member, and charging means, developing means and cleaning means, which is detachably mountable to a main assembly of an image forming apparatus. It may include, as a unit, an electrophotographic photosensitive member and at least one of charging means, developing means and cleaning means. It may include, as a unit, developing means and an electrophotographic photosensitive member.

An image forming apparatus using an electrophotographic process is known, which is used with the process cartridge. This is advantageous in that the maintenance operation can be, in effect, carried out by the users thereof without expert service persons, and therefore, the operativity can be remarkably improved. Therefore, this type of device is now widely used.

In such an electrophotographic image forming apparatus, the electrophotographic photosensitive member is supported on a cartridge frame at opposite longitudinal ends to stably rotate the photosensitive drum.

SUMMARY OF THE INVENTION

It is a principal object of the present invention to provide a further improvement in the prior art structure.

It is a principal object of the present invention to provide a mounting member, a drum flange using the mounting member, an electrophotographic photosensitive drum and a process cartridge.

It is an object of the present invention to provide a mounting member, a drum flange using the mounting member, and an electrophotographic photosensitive drum and a process cartridge wherein the flange can be mounted to a cylindrical member using elastic force.

According to an aspect of the present invention, there is provided a mounting member for mounting a flange to an end of a cylindrical member of an electrophotographic photosensitive drum, comprising: a base plate; a hole provided at a center portion of the base plate; a plurality of first projected portions provided projected outwardly from an edge of the base plate, for elastic contact to an inner surface of the flange; a plurality of second projected portions provided to project outwardly from an edge of the base plate, for elastic contact to an inner surface of the flange.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 26 illustrates the deterioration of a circularity of a photosensitive drum 7 when there is no engaging portion 52 of the main body 50 and pawls 92*a*–92*h* of the clamping plate 90. In this figure, a thickness of a wall of the photosensitive drum 7 is 1 mm.

DESCRIPTION OF THE PREFERRED EMBODIMENTS

Hereinafter, preferred embodiments of the present invention will be described with reference to the drawings.

Figure 1:
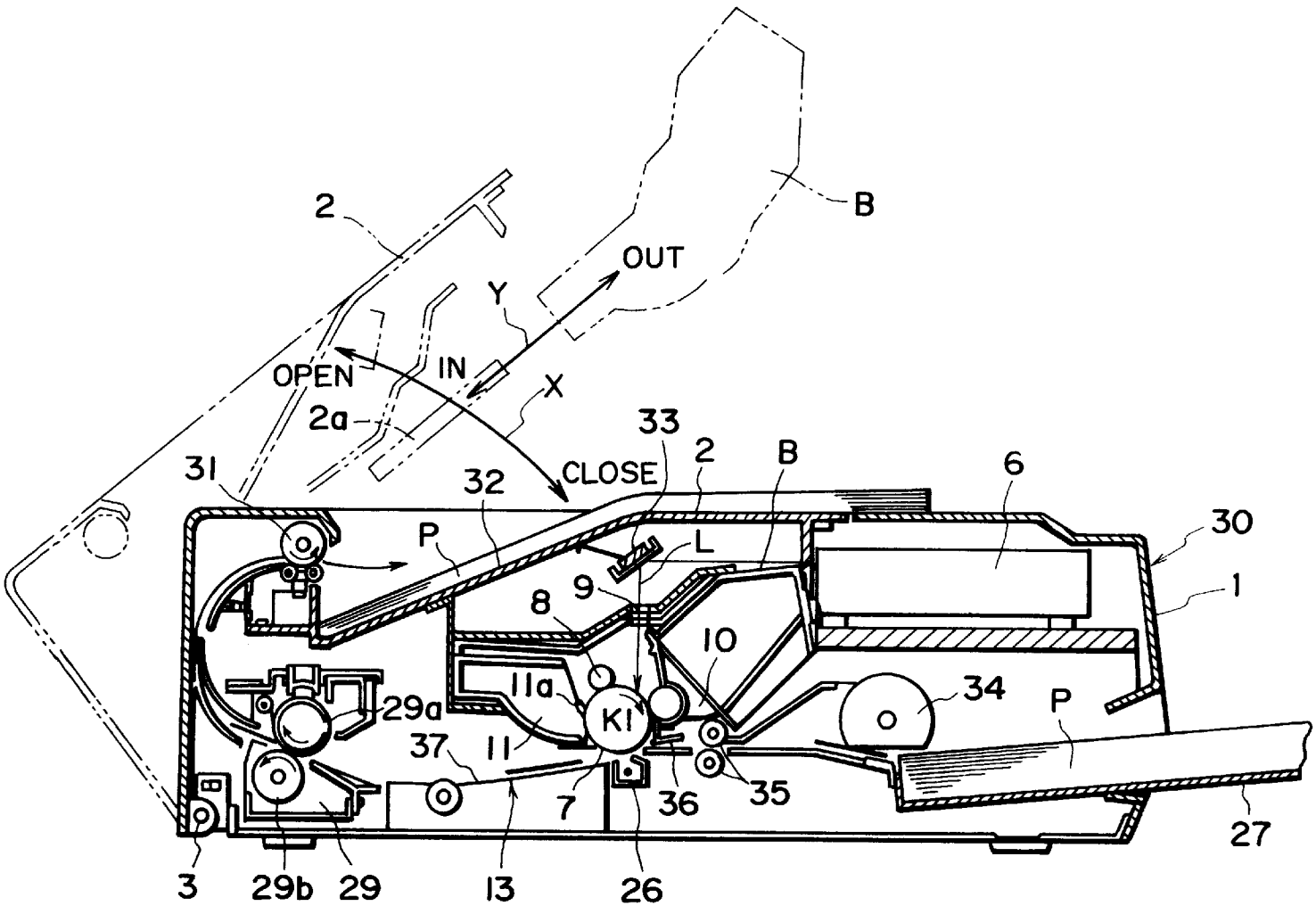
FIG. 1 is a longitudinal sectional view of an electrophotographic image forming apparatus using a process cartridge.

FIG. 1 schematically illustrates an electrophotographic image forming apparatus (printer) which employs a process cartridge in accordance with the present invention. This electrophotographic image forming apparatus (hereinafter, "image forming apparatus") is a laser beam printer, which is based on an electrophotographic process, and employs a removably installable process cartridge.

In other words, this image forming apparatus is constituted of the main assembly and a removably installable process cartridge. The main assembly comprises a structural frame constituted of two pieces: a top portion 2 and a bottom portion 1. The top portion 2 is hinged to the rear side (left side in FIG. 1) of the bottom portion 1 with the use of a hinge pin 3, so that it can be rotated in the direction indicated by an arrow mark (I), about the hinge pin 3 to enable it to take two positions: an open position (outlined by double dot chain line) and a closed position (outlined by solid line). When the top portion 2 is at the open position, a process cartridge B (which will be described later in detail) can be installed into, or removed from, the main assembly in the direction indicated by an arrow mark (YO). The top portion 2 is provided with a pair of guides 2*a* as an installation-removal means along which the process cartridge B is installed or removed in the arrow (YO) direction. The guide 2*a* is in the form of a long groove, whereas the cartridge frame 12 of the process cartridge B. guided by the guide 2*a* is provided with a pair of guides (unillustrated) in the form of a tongue, which fit in the pair of guides 2*a*, one for one. The cartridge frame 12 will be described later in detail.

As the top portion 2 of the structural frame of the apparatus main assembly is closed, the process cartridge B is placed at a predetermined position in the main assembly. With the process cartridge B at the predetermined position in the main assembly, a laser scanner unit 6, which constitutes the main portion of an exposing apparatus, is located on the front side (right-hand side in FIG. 1) of the process cartridge B, and a sheet cassette 27, in which a plurality of sheets P, that is, image media, are held, is located below the process cartridge B. On the downstream side of the sheet cassette 27 in terms of the direction in which the sheet P is conveyed, a sheet feeder roller 34, a registration roller pair 35, a transfer guide 36, a transfer charger 26 as a transferring means, a sheet conveyer 37, a fixing device 29, and the like are arranged in the listed order. These components are all disposed in the bottom portion 1 of the structural frame of the main assembly, whereas a sheet discharge roller 31, a delivery tray 32, and a reflection mirror 33, which are on the downstream side of the fixing device 29 are disposed, along with the process cartridge B, in the top portion 2 of the structural frame of the main assembly.

In this embodiment, the sheet feeder roller 34, the registration roller pair 35, the transfer guide 36, the sheet conveyer 37, the sheet discharge roller 31, and the like constitute a conveying means 13 for conveying the sheet P as recording medium.

Figure 2:
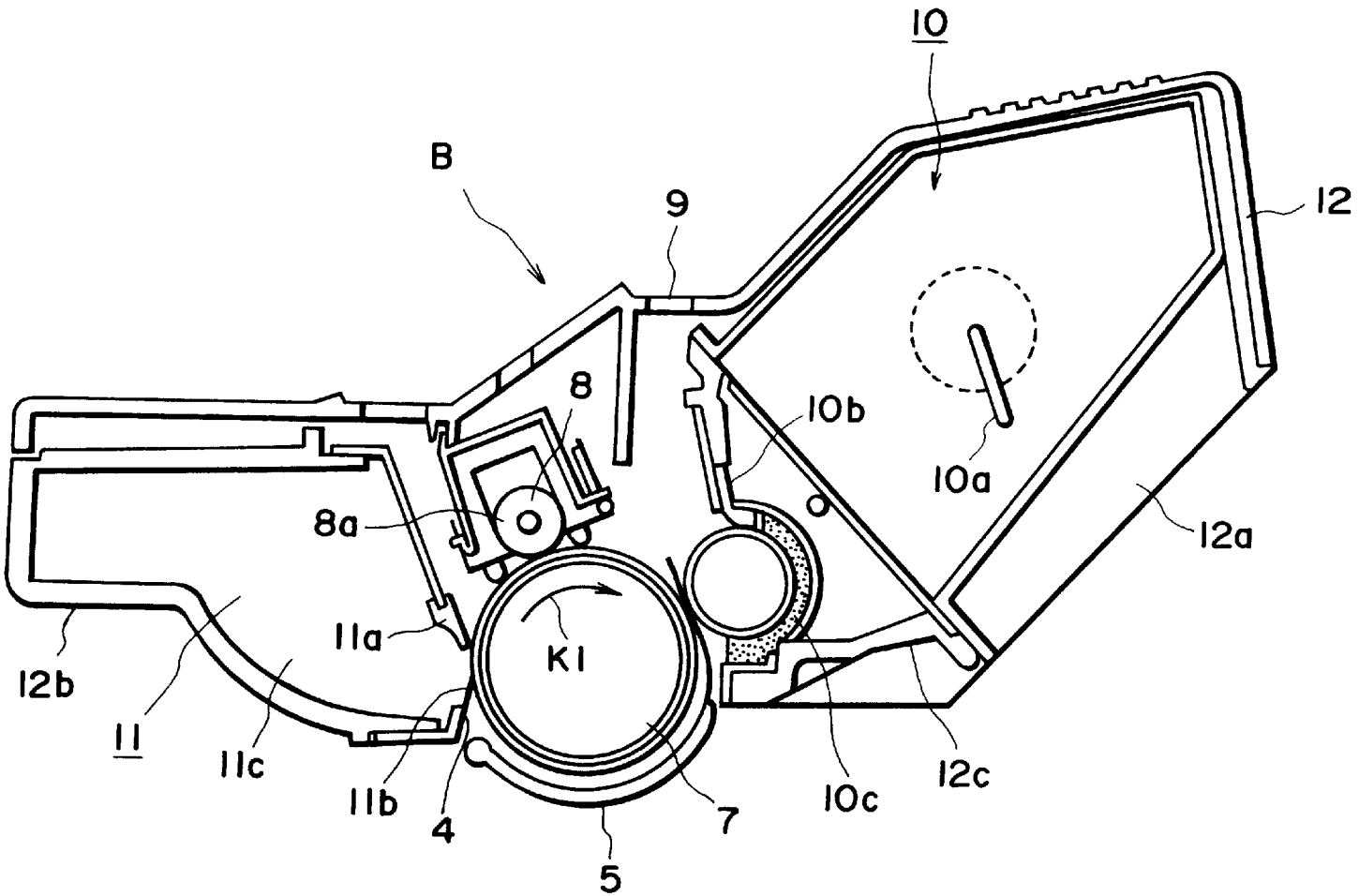
FIG. 2 is a longitudinal sectional view of a process cartridge usable with the electrophotographic image forming apparatus shown in FIG. 1.

Referring to FIG. 2, the process cartridge B comprises a structural frame 12 constituted of a toner frame 12*a*, a cleaning frame 12*b*, and a development frame 2*c*. The toner frame 12*a* stores toner. The development frame 12*c* is attached to the toner frame 12*a*, and the cleaning frame 12*b* is attached to the development frame 12*c*. This cartridge frame 12 integrally contains four processing devices: a photosensitive drum (electrophotographic photosensitive member) 7, a charging means 8, a developing means 10, and a cleaning means 11. The photosensitive drum 7 is a rotative cylindrical member, and the charging member 8 comprises a rotative roller 8*a*. The developing means 10 rotatively supports a development roller 10*c*, and the cleaning means 11 comprises a cleaning blade lla and a waste toner bin 11*c*. The top wall of the cartridge frame 12 is provided with an exposure window 9, which is formed by cutting or drilling. The bottom wall of the cartridge frame 12 is provided with a cover 5, which can be opened to expose, or closed to cover, the opening 4 through which an image formed on the photosensitive drum 7 is transferred onto the recording medium. The cover 5 moves to the closed position to cover the opening 4, protecting the photosensitive peripheral surface of the photosensitive member 7 as the process cartridge B is removed from the main assembly of the printer (electrophotographic image forming apparatus), or the top portion 2 of the structure frame of the main assembly is opened.

Next, an image forming process will described in general terms. Upon reception of a process start signal, the photosensitive drum 7 is rotatively driven in the direction indicated by an arrow mark RI at a predetermined peripheral velocity (process speed). The peripheral surface of the photosensitive drum 7 is in contact with the charge roller 8*a* of the charging means 8, to which a bias voltage is applied. Thus, as the photosensitive drum 7 is rotatively driven, the peripheral surface of the photosensitive drum 7 is uniformly charged by this charging means 8.

From the laser scanner unit 6, a laser beam L modulated with sequential digital electric signals, which reflect image data, is outputted. The laser beam L is reflected by the reflection mirror 33, and enters the cartridge frame 12 through the exposure window 9 of the top wall of the cartridge frame 12, exposing the charged peripheral surface of the photosensitive drum 7 in a scanning manner. As a result, an electrostatic latent, image which reflects the image data, is formed on the peripheral surface of the photosensitive drum 7. This electrostatic latent image is developed by a layer of developer (toner) coated on the peripheral surface of the development roller 10*c*. The thickness of the layer of the toner is regulated by the development blade 10*b* of the developing means 10. The toner is sent from the toner frame 12*a* into the development frame 12*c* by the toner sending member 10*a* disposed in the toner frame 12*a*.

Meanwhile, the plurality of sheets P stored in the sheet cassette 27 are sent out, one by one, from the sheet cassette 27 by the sheet feeder roller 34. Then, the sheet P is delivered to the transfer station, that is, the interface between the peripheral surfaces of the photosensitive drum 7 and transfer charger 26, by the registration roller pair 35, through the transfer guide 36, with a timing coordinated with the timing for the outputting of the laser beam L. In the transfer station, the toner image on the photosensitive drum 7 is transferred onto the sheet P starting from the downstream end.

After the toner image is transferred onto the sheet P, the sheet P is separated from the photosensitive drum 7, and then is conveyed to the fixing device 29 by the sheet conveyer 37. in the fixing device 29, the sheet P is put through the nip formed by the fixing roller 29*a* and pressure roller 29*b*. While the sheet P is put through the nip, the toner image is fixed to the sheet P. Then, the sheet P with the fixed toner image is discharged into the delivery tray 32 by the sheet discharge roller 31. After the image transfer, the photosensitive drum 7 is cleaned by the cleaning means; and the toner particles remaining on the peripheral surface of the photosensitive drum 7 are removed by the cleaning blade 11*a* of the cleaning means 11. The removed toner particles are guided into the waste toner bin 11*c* by a scooping sheet 11*b*. Thereafter, the cleaned portion of the peripheral surface of the photosensitive drum 7 is used for the next cycle of the image forming process, which starts from the charging of the photosensitive drum 7.

Supporting Structure for Photosensitive Drum 7

Figure 3:
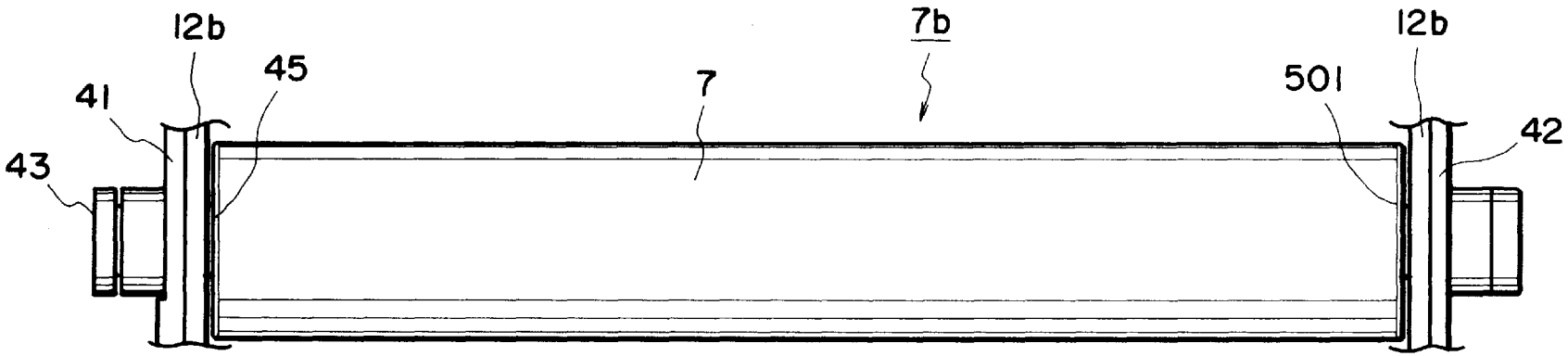
FIG. 3 is a side view illustrating a supporting structure for a photosensitive drum.

FIG. 3 is a side view of the structure for supporting the photosensitive drum .7.

Referring to FIG. 3, referential characters 7*b* and 7 designate a drum unit and a photosensitive drum 71 respectively. A referential character 45 designates a drum flange assembly, which is attached to one of the longitudinal ends, that is, the driving side end, of the photosensitive drum 7 (cylindrical drum 600), by crimping or the like method.

A reference character 41 designates a cover member of the cleaning frame 12*b*, which is located on the driving side. A reference character 43 designates a means for transmitting a driving force, which is constituted of a certain type of coupler. This driving force transmitting means 43 is engaged with an unillustrated axial member fixed to the drum flange 45 by insert molding or the like method, and transmits the driving force from the printer main assembly to rotate the photosensitive drum 7.

A reference character 501 designates a drum flange assembly attached to the other end, that is, the end opposite to the driving end, of the photosensitive drum 7. A reference character 50 designates the drum flange of the drum flange assembly 501, and a reference character 42 designates the cover of the cleaning frame 12*b*, on the side opposite to the driving side.

The drum unit 7*b* comprises the photosensitive drum 7 and drum flange assemblies 45 and 501.

Structure of Drum Flange 7*b*

Figure 4:
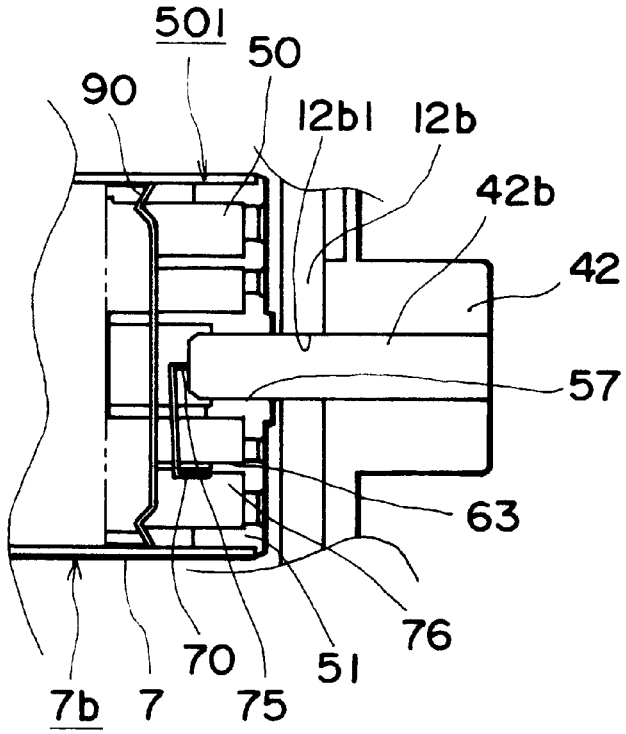
FIG. 4 is a sectional view of a drum flange at a non-driving side of a drum unit.

FIG. 4 is sectional view of one of the longitudinal end portions of the drum unit 7*b*, on the side opposite to the driving side, adjacent to the drum flange assembly 501.

In FIG. 4, a reference character 42*b* designates an electrically conductive axial shaft as the central axis, which is fixed to the cover 42 on the side opposite to the driving side by insert molding or the like method. It is made of steel, being formed by turning, and is plated with nickel.

The electrically conductive shaft 42*b*, which is the axial member, is put through a hole 12*b*1 of the cleaning frame 12*b*, so that it doubles as the member which fixes the positional relationship between the cleaning frame 12*b* and the photosensitive drum 7.

A reference character 70 designates a plate for grounding the photosensitive drum 7. This drum grounding member 70 is attached to the drum flange 50 of the drum flange assembly 501 with the use of an anchoring or clamping plate 90 which functions as a mounting member for mounting the flange 70, constituted of a piece of elastic plate, being pinched between the drum flange 50 of the drum flange assembly 501 and the clamping plate 90.

The drum grounding plate 70 is provided with an elastic arm portion 75, or the first springy arm portion, which will be described later. It is electrically connected to the electrically conductive shaft 42*b*, and grounds the photosensitive drum 7 through the ground contact portions 73*a* and 73*b* of cylinder contact springs 77*a* and 77*b* as the second plate sprints, which also will be described later.

Structure of Drum Flange 50 of Drum Flange Assembly 501

Figure 5:
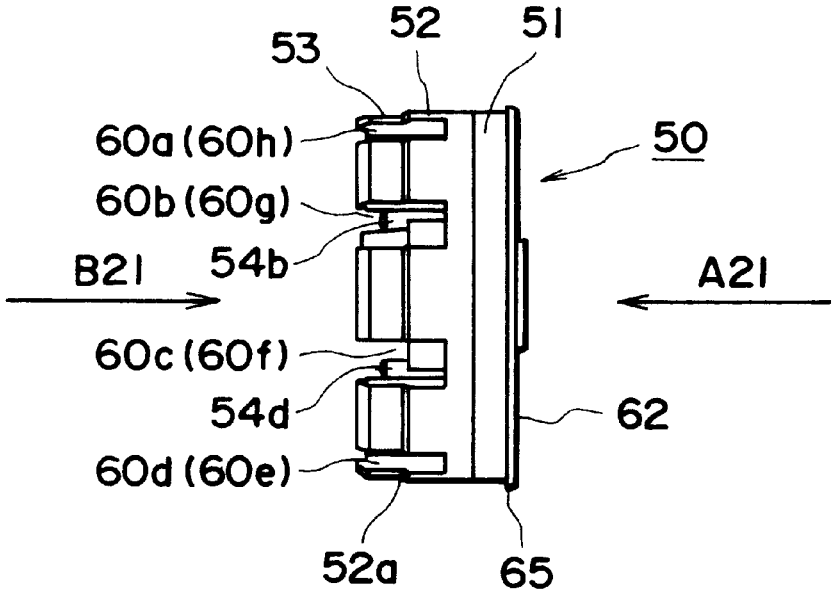
FIG. 5 is a side view of a body of the drum flange.

FIG. 5 is a side view of the drum flange 50 of the drum flange assembly 501 illustrated in FIG. 4.

The drum flange 50 of the drum flange assembly 501 is formed of resin. Its peripheral wall portion comprises a stopper portion 65, and a portion 51, a portion 52, and a guide portion 53, which are to be fitted into the photosensitive drum 7. The stopper portion 65 is portion which fixes the positional relation between the drum flange 50 and the photosensitive drum 7 in the longitudinal direction of the photosensitive drum 7. The fitting portion 51 is a portion which is pressed into the photosensitive drum 7, and the fitting portion 52, or the second portion, is a portion which also is pressed into the photosensitive drum 7. The pressure applied to the portion 52 to fit it into the photosensitive drum 7 is lighter than the pressure applied to the portion 51 to insert it into the photosensitive drum 7. The insert guide portion 53 is a portion which is fitted into the photosensitive drum 7, perfectly or with some play.

Figure 19:
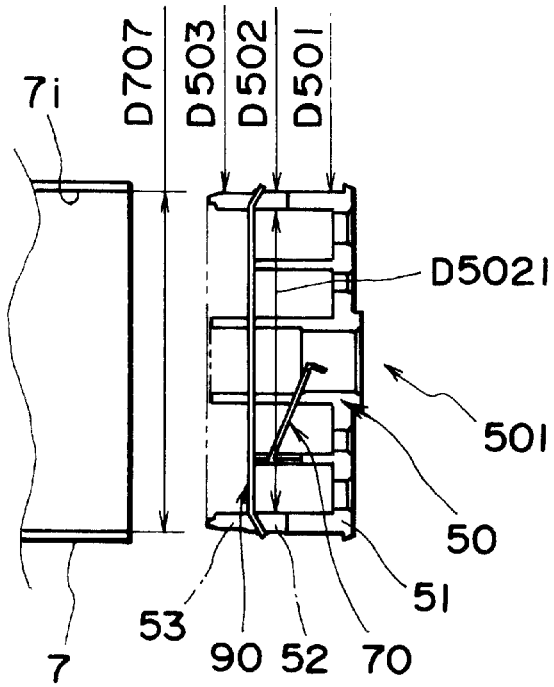
FIG. 19 is an illustration of the relation between the diameters of the drum flange and the photosensitive drum.

Referring to FIG. 19, the external diameter D501 of the fitting portion 51 is 1.0005 to 1.005 times the internal diameter D705 of the photosensitive drum 7. The external diameter D502 of the fitting portion 52 is 0.999 to 1.002 times the internal diameter D707 of the photosensitive drum 7. The external diameter D503 of the fitting guide portion 53 is exactly matched to the internal diameter D707 of the photosensitive drum 7 so that it perfectly fits into the photosensitive drum 7, that is, without leaving any gap.

The fitting portion 52 is provided with an edge portion 52*a*, which is located on the fitting guide portion 53 side. The edge portion 52*a* is constituted of a rib which circles the peripheral surface of the drum flange 50. It projects 0.5 mm to 3 mm in the radial direction of the drum flange 50. The internal diameter D502 of the fitting portion 52 is smaller than the diameter D902 of the circumcircle of the flange gripping extensions 92*a*–92*h*.

Figure 6:
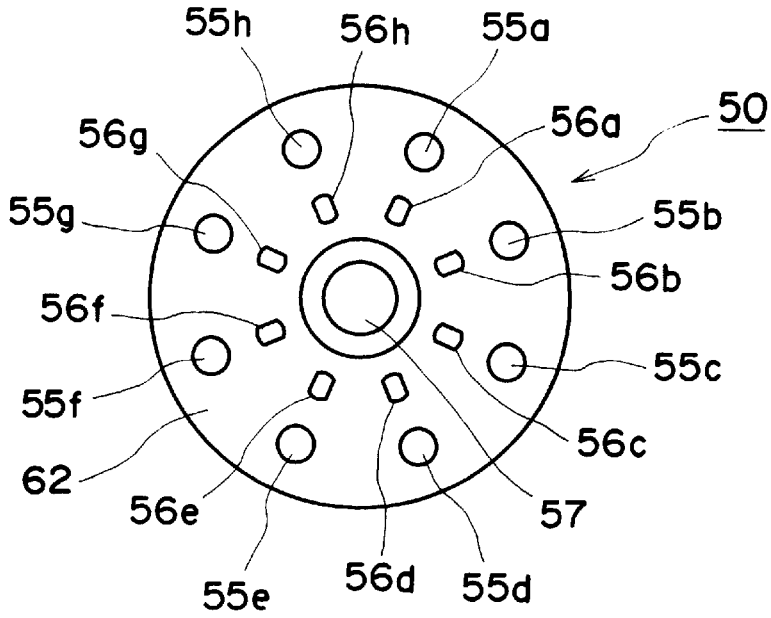
FIG. 6 is a rear view of a body of the drum flange.

FIG. 6 is an illustration of the drum flange 50 as seen from the direction indicated by an arrow mark A2 in FIG. 5.

In FIG. 6, reference characters 55*a*–55*h* designate through holes for a pressing tool 631 for pressing the cylinder gripping extensions or cylinder clamping pawls 91*a*–91*h* of the clamping plate 90. Reference characters 56*a*–56*h* designate holes with which the circular flat wall 62 of the drum flange 50 is provided for positioning the pressing tool 631 in terms of the rotational direction of the photosensitive drum 7; the pressing tool 631 is accurately positioned relative to the drum flange 50 by the holes 56*a*–56*h*, assuring that the clamping plate 90 is pressed, on the correct points 99.

A reference character 57 designates a hole through which the electrically conductive shaft 42*b* is put, as tightly as possible while allowing the photosensitive drum 7 to rotate about the shaft 42*b*.

Figure 7:
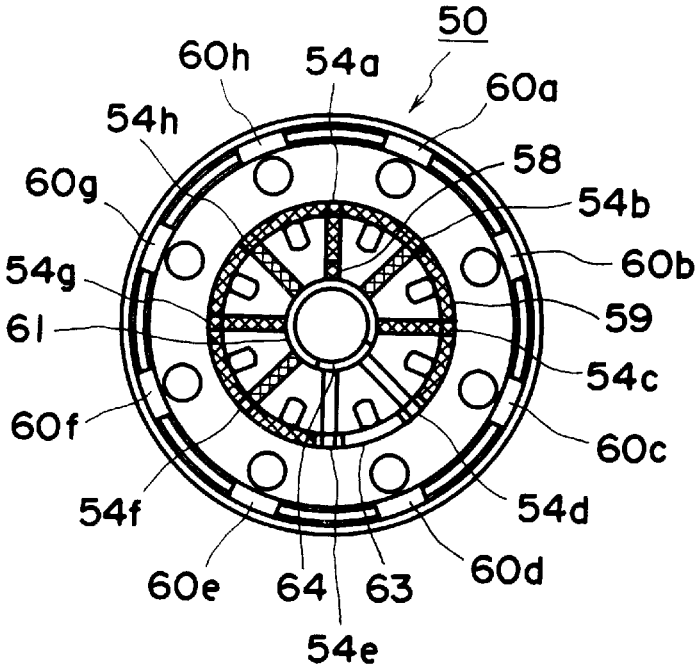
FIG. 7 is a front view of the body of the drum flange.

FIG. 7 is a front view of the drum flange 50 of the drum flange assembly 501 illustrated in FIG. 4 as seen from the direction indicated by an arrow mark B21 in FIG. 5.

In FIG. 7, a reference character 58 designates a rectangular boss that accurately fixes the positional relationship between the drum grounding plate 70 and the clamping plate 90 in terms of the rotational direction of the photosensitive drum 7. In other words, with the presence of this boss 58, the pressing tool 631 is accurately aligned with the cylinder gripping rectangular radial extensions 91*a*–91*h* of the clamping plate 90, assuring that the correct points 99 of the clamping plate 90 are pressed.

A reference character 59 designates the inward end surface of the drum flange 50, or the hatched portion in the drawing. This is the surface to which the drum grounding plate 70 is attached. It is precisely formed.

Reference characters 54*a*–54*h* designate bosses for holding the drum grounding plate 70 and clamping plate 90 to the drum flange 50. They are melted after these plates 70 and 90 are mounted.

Reference characters 60*a*–60*h* designate slots cut in the fitting portion 52 and fitting guide portion 53 of the drum flange 50. As described before, the elastic contact portions 73*a* and 73*b* of the grounding plate 70, and the rectangular, radial, cylinder clamping pawls 91*a*–91*h* of the clamping plate 90, are put through these slots, being placed in contact with the inside surface 7*i* of the photosensitive drum 7.

A reference character 61 designates a cylindrical boss for centering the drum grounding plate 70 and clamping plate 90 relative to the drum flange 50. This boss 61 makes it possible for the eight cylinder clamping pawls 91*a*–91*h* of the clamping plate 90 to make contact with the inside surface 7*i* of the photosensitive drum 7, on the predetermined points, with uniform pressure.

A reference character 64 designates a slot for the elastic shaft contact arm portion 75 of the drum grounding plate 70. The slot 64 affords the elastic arm portion 75 of the drum grounding plate 70 a sufficient stroke range, so that an accurate amount of pressure is generated by the elastic shaft contact portion 75.

A reference character 63 designates a rib, which presses down on the drum grounding plate 70, engaging with the bend portion 76 of the drum grounding plate 70. The bend portion 76 will be described later. More specifically, the rib 63 presses down on the end portion of the bend portion 76 of the drum grounding plate 70, assuring that a proper amount of pressure is applied to the electrically conductive shaft 42*b* by the elastic arm portion 75 of the drum grounding plate 70, and therefore assuring electrical conductivity.

Structure of Drum Grounding Plate 70

Figure 8:
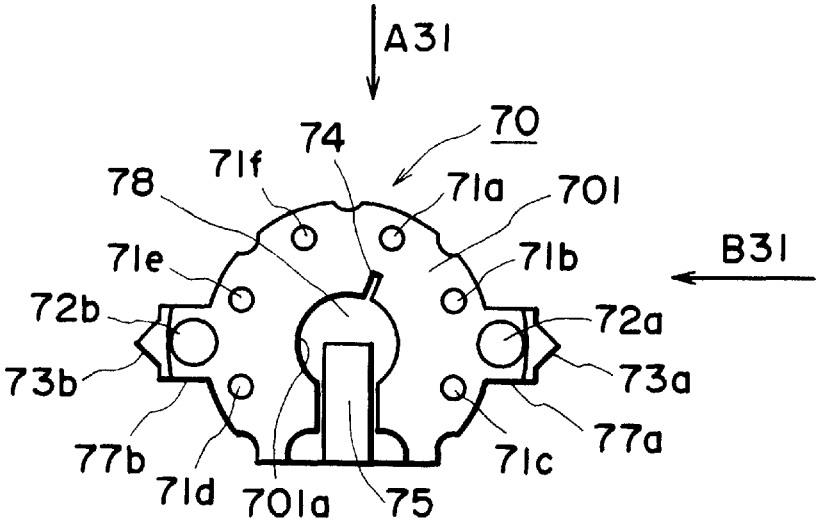
FIG. 8 is a front view of a drum grounding plate.

FIG. 8 is a front view of the drum grounding plate 70.

The drum grounding plate 70 is formed of phosphor bronze or the like, which is electrically conductive and also elastic. It comprises the first elastic contact portions 75*a*, and the second elastic contact portions 73*a* and 73*b*, which will be described later. The first elastic contact portion 75*a* makes contact with the electrically conductive shaft 42*b* of the cover 42, which is placed in contact with the ground portion (unillustrated) of the printer main assembly. The second contact portions 73*a* and 73*b* are placed in contact with the inside surface 7*i* of the photosensitive drum 7. With the presence of the above described structure, the photosensitive drum 7 is grounded to the ground portion of the printer main assembly.

The contact portion 75*a* is provided at the end of the elastic arm portion 75 of the drum grounding plate 70 (FIGS. 9 and 10), and the second Lcontact portions 73*a* and 73*b* are provided at the end portions of the cylinder springs 77*a* and 77*b*, respectively. The first contact portion 75*a* and the second contact portions 73*a* and 73*b* are angularly shaped.

The springs 77*a* and 77*b* are identically shaped, and are symmetrically positioned relative to the center line (750) of the elastic arm portion 75 of the drum grounding plate 70, that is, the line drawn through the point of contact between the contact portion 75*a* and the electrically conducive shaft 42*b* and the center of the elastic arm portion 75.

Reference characters 72*a* and 72*b* designate through holes, which are cut through the springs 77*a* and 77*b*. Cutting these holes 72*a* and 72*b* through the spring portions 77*a* and 77*b* reduces the widths of the spring portions 72*a* and 72*b* in terms of material, reducing thereby their resiliency, without reducing the widths of the spring portions 72*a* and 72*b* in terms of structure, maintaining thereby virtually the same structural strength as that provided when no hole is cut.

Reference characters 71*a*–71*h* designate holes, through which the aforementioned thermally deformable bosses 54*a*–54*f* are put, one for one; they are aligned in a circle, which has the same center and diameter as those of the circle in which the thermally deformable bosses 54*a*–54*h* of the drum flange 50 are aligned, and also are aligned with the same pitch as those bosses. The holes 71*b* and 71*c* are symmetrically positioned to each other relative to the center line 77*o*1 of the spring portion 77*a*, and the holes 71*d* and 71*e* are symmetrically positioned to each other relative to the center line of the spring portion 77*b*. The thermally deformable bosses 54*b*, 54*c*, 54*f* and 54*g* are put through these holes 71*b*, 71*c*, 71*d* and 71*e*, one for one in the listed order, and then, are melted to hold the drum grounding plate 70 to the drum flange 50. As a result, it is assured that pressure is uniformly applied to the spring portions 77*a* and 77*b* by the two pairs of deformed bosses 54*b*, 54*c*, 54*f* and 54*g*. The above arrangement assures that the drum grounding plate 70 remains correctly positioned relative to the drum flange assembly 501 when the drum flange assembly 501 is inserted into the photosensitive drum 7, and that the spring portions 77*a* and 77*b* are prevented from being easily twisted.

The contact portions 73*a* and 73*b* of the 701 are angularly shaped as described before, and therefore, the angular tips and finned edges of the contact portions 73*a* and 73*b* assure that sufficient electrical conductivity is maintained between the inside surface 7*i* of the photosensitive drum 7 and the contact portions 73*a* and 73*b*.

A reference character 74 designates a slot for fixing the position of the drum grounding plate 70 relative to the drum flange 50 in terms of the rotational direction of the photosensitive drum 7. The slot 74 engages with the rectangular positioning boss 58 to fix the angle of the drum grounding plate 70 relative to the drum flange 50.

Figure 9:
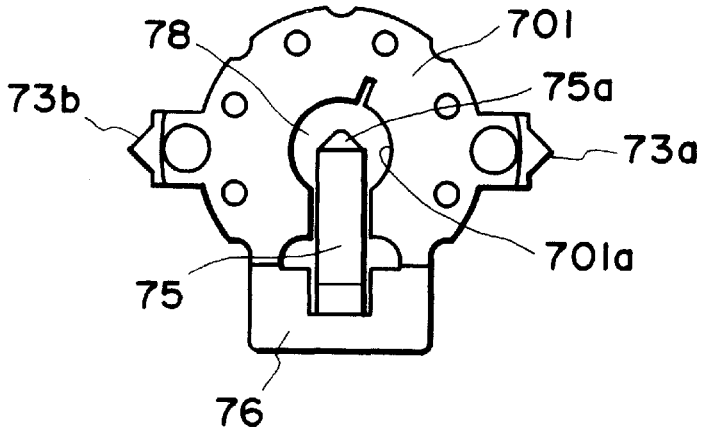
FIG. 9 is a front view of a drum grounding plate before shaping.

FIG. 9 is a development of the drum grounding plate 70. The drum grounding plate 70 is constituted of a single piece of approximately 0.2 mm thick metallic plate. As for the manufacturing method for the drum grounding plate 70, pressing or the like method is used so that a strong drum grounding plate with high strength can be economically manufactured.

Figure 10:
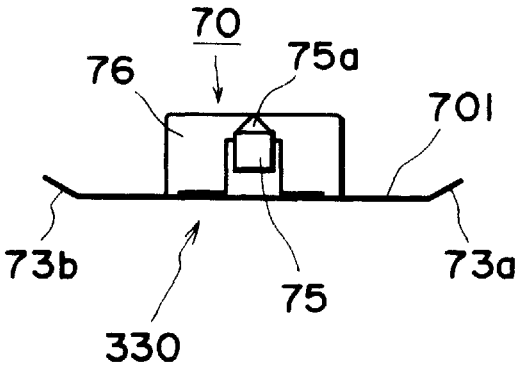
FIG. 10 is a top plan view of a drum grounding plate.

FIG. 10 is a top view of the drum grounding plate 70 as seen from the direction indicated by an arrow mark A31 in FIG. 8.

Referring to FIG. 9, the drum grounding plate 70 is a single piece of metallic plate formed by pressing or the like method as described above. It is constituted of a portion 701, which is flat and substantially round, and a smaller portion 76, which extends almost perpendicularly from the flat and round portion 701. The flat and round portion 701 is provided with a hole 78, through which the electrically conductive shaft 42*b* is put, and the slot 701*a*. It is placed flatly in contact with the drum flange 50. The perpendicular smaller portion 76 is provided with the elastic arm portion 75, which is tilted toward the flat and round main portion 701*a* so that it makes contact with the electrically conductive shaft 42*b*. The smaller portion 76, substantially perpendicular to the flat and round main portion 701, also makes contact with the rib 63 of the drum flange 50, assuring that the elastic arm portion 75 of the drum grounding plate 70 generates a contact pressure of 50 g to 100 g.

With the above described arrangement, it is possible to provide the drum grounding plate 70 with a longer elastic arm portion 75, which has a smaller constant of elasticity.

The drum grounding plate 70 is formed by pressing so that the fins are created on the side 330 indicated by an arrow mark 330. Therefore, the drum grounding plate 70 makes contact with the inside surface 7*i* of the photosensitive drum 7, by the finned side of the edge, assuring reliable contact.

Figure 11:
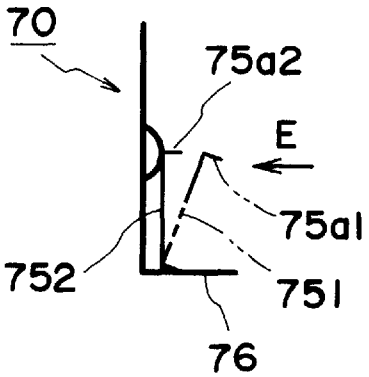
FIG. 11 is a side view of a drum grounding plate.

FIG. 11 is side view of the drum grounding plate 70 as seen from the direction indicated by an arrow mark B31 in FIG. 4.

As the drum unit 7*b* is assembled into the structural frame of the process cartridge B, the elastic arm portion 75 for the first contact point 75*a* is pressed in the direction indicated by an arrow mark E by the electrically conductive shaft 42*b*, being elastically bent from the position outlined by a double dot chain line 751 to the position outlined by the solid line 752, causing the contact point 75*a* to come in contact with the electrically conductive shaft 42*b*. The contact point 75*a*, placed in contact with the electrically conductive shaft 42*b*, is kept in contact with the shaft 42*b* by the resiliency of the elastic arm portion 75 while being allowed to slide on the peripheral surface of the shaft 42*b*. When the elastic arm portion 75 is at the position outlined by the solid line 752, the contact point 75*a* is at a position 75*a*2, having been moved from a position 75*a*1 at which it was before the elastic arm portion 75 was pressed by the electrically conductive shaft 42*b*. Thus, after the assembly, the contact point 75*a* remains in contact with the rotational center portion of the electrically conductive shaft 42*b*, and yet, it is prevented from being easily worn by friction.

Structure of Clamping Plate 90

Figure 12:
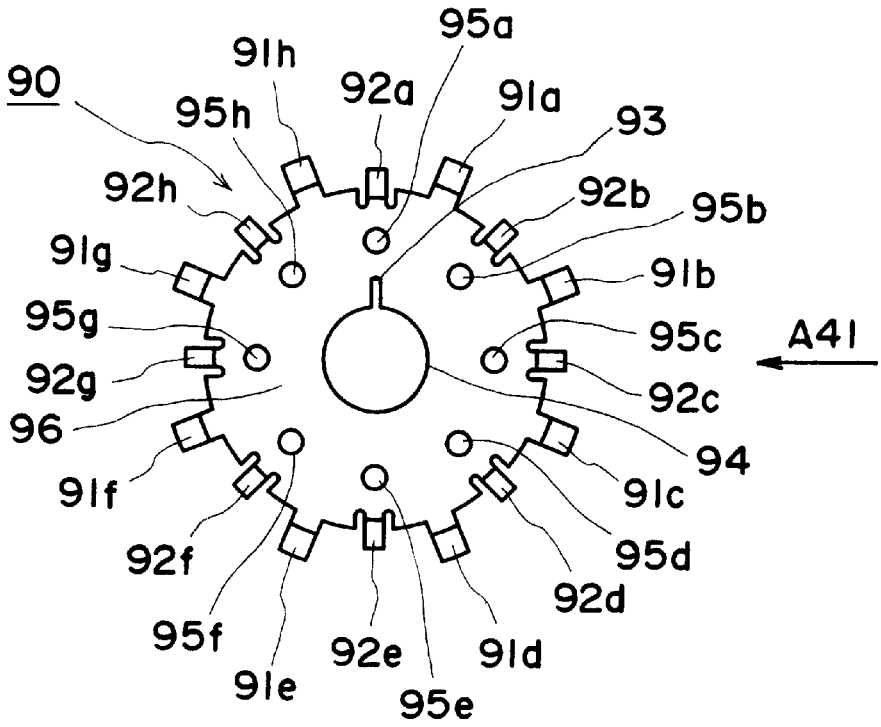
FIG. 12 is a front view of a clamping plate.

FIG. 12 is a front view of the clamping plate 90 as a means for clamping the drum flange 50 to the photosensitive member 7.

The clamping plate 90 is a plate-like member formed of approximately 0.1 mm–0.5 mm thick plate of SUS (stainless steel), phosphor bronze, or the like material. go Here, an clamping plate 90 formed of 0.2 mm thick SUS304P will be described as an example.

In FIG. 12, referential characters 91*a*–91*h* are radial rectangular, cylinder clamping pawls of the clamping plate 90 as the second extensions. As the drum flange assembly 501 is inserted into the photosensitive drum 7 after the clamping plate 90 is attached to the drum flange 50, the extensions 91*a*–91*h* come in contact with the inside surface 7*i* of the photosensitive drum 7, and firmly anchor themselves to the inside surface 7*i*. The extensions 91*a*–91*h* are tilted toward the bottom end surface 62 of the drum flange 50 so that it becomes easier for the clamping plate 90 to be inserted into the photosensitive drum 7. Further, tilting the extensions 91*a*–91*h* as described above causes them to bite into the inside surface 7*i* of the photosensitive drum 7 as force applies to the clamping plate 90 in the direction to push the drum flange assembly 501 out of the photosensitive drum 7. Therefore, the clamping plate 90 is prevented from easily coming out of the photosensitive drum 7. The diameter D901 (FIG. 13) of the circumcircle of the extensions 91*a*–91*h* is made to be 1.01–1.05 times the internal diameter D707 (FIG. 19) of the photosensitive drum 7, assuring that a sufficient amount of force is generated to cause the extensions 91*a*–91*h* to come in contact with the inside surface 7*i* of the photosensitive drum 7, and anchor themselves to the inside surface 7*i*.

The tip of each of the cylinder clamping pawls 91*a*–91*h* is shaped square, and makes contact with the inside surface 7*i* of the photosensitive drum 7 across its entire edge. In other words, the tip of each extension makes contact with the inside surface 7*i* of the photosensitive drum 7, across the wide area of the surface 7*i*, preventing thereby the cylinder from deteriorating in terms of circularity. Further, the extensions 91*a*–91*h* cause the coating on the inside surface 7*i* of the photosensitive drum 7 to be stripped across the wide area.

Referential characters 92*a*–92*h* designate the first rectangular, radial, drum flange clamping pawls of the clamping plate 90. The extensions 92*a*–92*h* make contact with the inside surface 52*b* of the fitting portion 52 of the drum flange 50. They are tilted in the direction opposite to the tilt of the cylinder clamping pawl 91*a*–91*h*. This makes it easier for the clamping plate 90 to be inserted into the drum flange 50, while making it difficult for the clamping plate 90 to come out of the drum flange 50.

A reference character 93 designates a slot, which engages with the square boss 58 of the drum flange 50; engagement between the slot 93 and the boss 58 fixes the positional relationship between the drum flange 50 and the clamping plate 90 in terms of the rotational direction of the photosensitive drum 7. This makes it possible to accurately align the cylinder clamping pawls 91*a*–91*h* with the through holes 55*a*–55*h* for the pressing tool 631. Therefore, each cylinder clamping pawl 91*a*–91*h* can be pressed, on the precise spot, which will be described later. Further, the cylinder clamping pawl 91*a*–91*h* press themselves upon the inside surface 7*i* of the photosensitive drum 7 in a direction perpendicular to the inside surface 7*i*, anchoring themselves to the photosensitive drum 7 with maximum effectiveness.

Reference characters 95*a*–95*h* designate holes for the thermally deformable bosses 54*a*–54*h*. The holes 95*a*–95*h* are aligned in a circle with the same diameter as the circle in which the thermally deformable bosses 54*a*–54*h* are aligned, at the same pitch as the pitch at which the thermally deformable bosses 54*a*–54*h* are aligned.

Figure 13:
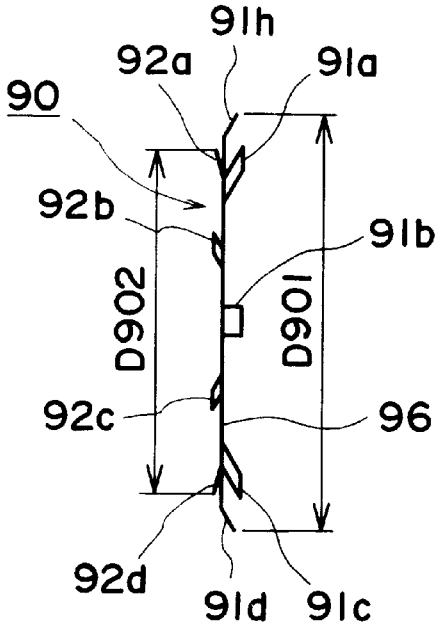
FIG. 13 is a side view of a clamping plate.

FIG. 13 is a side view of the clamping plate 90 as seen from the direction indicated by an arrow mark A41 in FIG. 12.

As illustrated in FIG. 13, the cylinder clamping pawls 91*a*–91*h* and the drum flange clamping pawl 92*a*–92*h* are tilted in the opposite directions. When the clamping plate 90 is assembled onto the drum flange 50, the clamping plate 90 is lined up so that the extensions 91*a*–91*h* tilt toward the circular inside surface 62 of the drum flange 50.

A reference character 96 designates the flat portion of the clamping plate 90. When the clamping plate 90 is assembled onto the drum flange 50, this flat portion 96 is placed in contact with the flat portion of the drum grounding plate 70, and then, the bosses 54*a*–54*h* are thermally deformed to retain the clamping plate 90. The flat portion 96 minimizes the deformation of the drum grounding plate 70 which occurs when the drum flange assembly 501 is inserted into the photosensitive drum 7.

Figure 14:
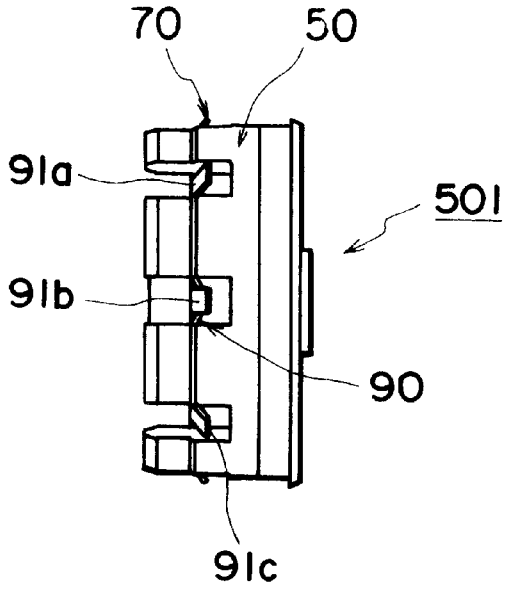
FIG. 14 is a side view of a drum flange.

FIG. 14 is a side view of the drum flange assembly 501.

The drum flange assembly 501 is constituted of the drum flange 50, which has been described so far, the drum grounding plate 70, and the clamping plate 90.

The clamping plate 90 is attached to drum flange 50 so that the extension 91*a*–91*h* tilt toward the circular inside surface 62 of the drum flange 50.

Lining up the clamping plate 90 as described above makes it easier to insert the drum flange assembly 501 into the photosensitive drum 7.

Internal Structure of Drum Flange Assembly 501

Figure 15:
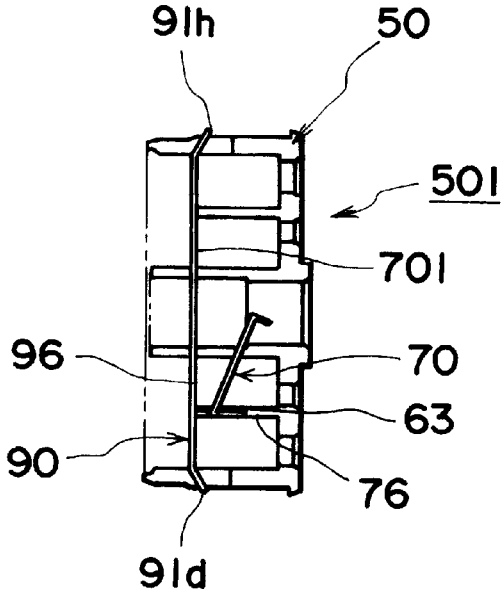
FIG. 15 is a sectional view of a drum flange.

FIG. 15 is a sectional view of the drum flange assembly 501 illustrated in FIG. 14.

The drum grounding plate 70 is attached to the drum flange 50 so that the bosses 54*a*–54*f* (unillustrated) are put through the holes 71*a*–71*f* (unillustrated) of the drum grounding plate 70, one for one. Then, the clamping plate 90 is attached to the drum flange 50, through the drum grounding plate 70.

Figure 16:
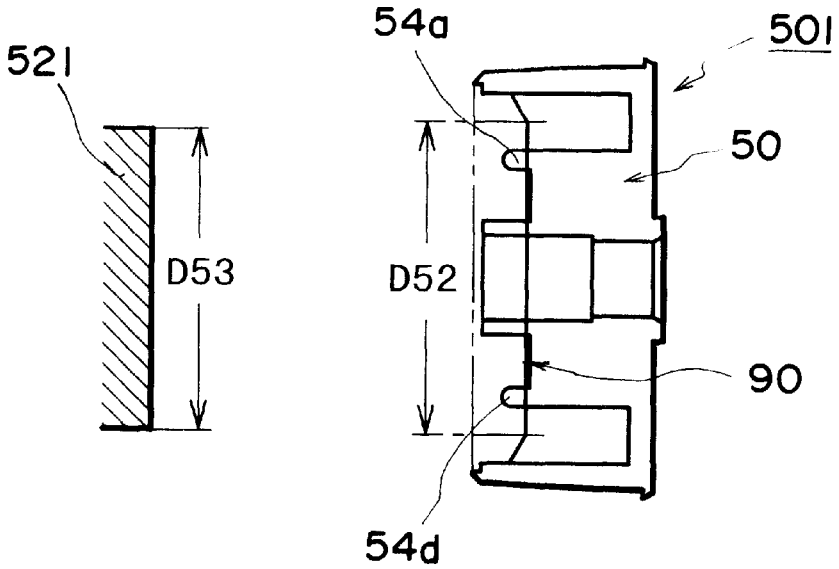
FIG. 16 is an illustration illustrating a mounting method of the drum flange to the main body.

FIG. 16 is a drawing which depicts how the clamping plate 90 is attached to the drum flange 50.

As depicted by FIG. 16, the clamping plate 90 is pressed into the drum flange 50 with the use of the pressing jig 521 after the drum grounding plate 70 is placed in the drum flange 50. As for the pressing jig 521, its diameter equals the diameter b52 of the circle drawn by connecting the points at which the extensions 92*a*–92*h* are to be bent. The jig surface, which makes contact with the clamping plate 90 when pressing the clamping plate 90, is flat. Therefore, the springiness of the extensions 92*a*–92*h* of the clamping plate 90 is not adversely effected as the clamping plate 90 is pressed into the drum flange 50. The bosses 54*a*–54*h* fit into the holes 95*a*–95*h* of the clamping plate 90 as the clamping plate 90 is pressed into the drum flange 50.

After the attachment of the clamping plate 90, the bosses 54*a*–54*h* of the drum flange 50 are melted to permanently hold the drum grounding plate 70 and clamping plate 90 to the drum flange 50, completing the drum flange assembly 501.

The clamping plate 90 is attached to the drum flange 50 as described above. Then, the bosses 54*a*–54*h* of the drum flange 50 are melted, being positioned so that the cylinder clamping pawls 91*a*–91*h* are positioned on a line drawn through the midpoint between the adjacent two bosses and the center of the clamping plate 90.

As the drum grounding plate 70 is placed in the drum flange 50 in the above described manner, the tilted portion 76 of the drum grounding plate 70 engages with the rib 63 of the drum flange 50. More specifically, as the drum grounding plate 70 is placed in the drum flange 50, the tilted portion 76 comes in contact with the electrically conductive shaft 42*b*, and is pushed backward by the shaft 42*b*, coming in contact with the rib 63, while a certain amount of stress, or resilient pressure, is generated in the elastic arm portion 75. In this state, the tilted arm portion 76 is supported by the lateral surface of the rib 63.

Figure 17:
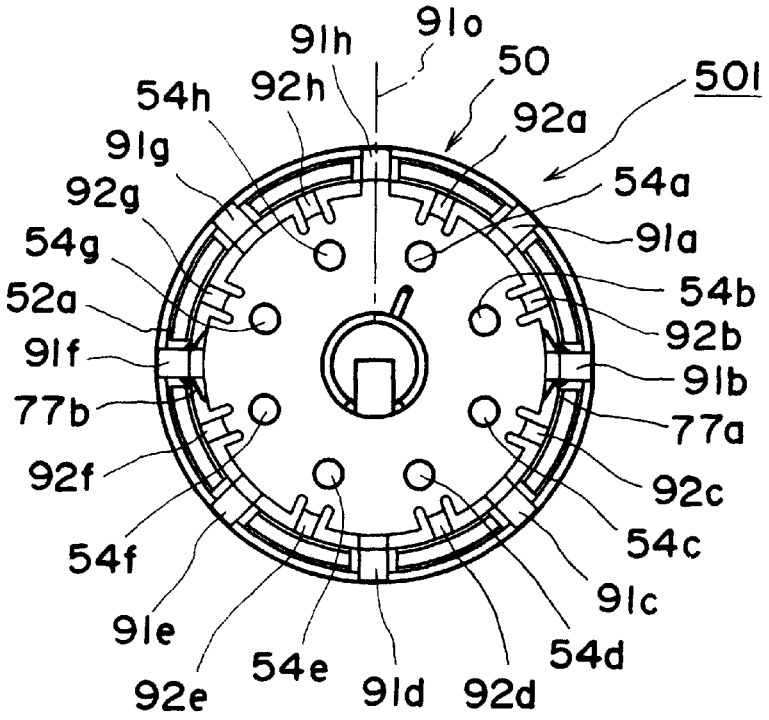
FIG. 17 is a front view of a drum flange.

FIG. 17 is a front view of the flange assembly 501, that is, the completed flange assembly 501, illustrated in FIG. 14, as seen from the side of bosses 54*a*–54*h*.

As illustrated in FIG. 17, the eight bosses 54*a*–54*h* of the drum flange 50 are aligned in a circle at the base portions of the drum flange clamping pawls 92*a*–92*h*, with the cylinder clamping pawls 91*a*–91*h* being positioned on a line drawn through the midpoint between the adjacent two bosses and the center of the clamping plate 90. More specifically, the thermally deformable bosses 54*a*–54*h* are aligned in a circle so that any adjacent two bosses are symmetrically positioned relative to the center line of a corresponding clamping extension. For example, the bosses 92*a* and 92*h* are symmetrically positioned relative to the center line 91*o* of the clamping extension 91*h*. Further, the bosses 54*a*–54*h* are aligned in a circle so that they do not align with extensions 91*a*–91*h* of the clamping plate 9 in the radial direction of the clamping plate 90, while the adjacent two bosses are positioned symmetrically relative to the center line of the corresponding clamping extension.

Further, as depicted in FIG. 17, the springy arm portion 77*a* and 77*b* of the drum grounding plate 70, which are positioned in symmetrically across the drum grounding plate 70, are held to the drum flange 50 by thermally deforming the pair of bosses 54*b* and 54*c* and the pair of bosses 54*f* and 54*g*. With this arrangement, the elastic arm portion 75 is firmly held down by the clamping plate 90, and therefore, the tilted elastic arm portion 75 is prevented from being pulled in the left or right direction, even though a certain amount of stress is generated in the elastic arm portions 77*a* and 77*b* when the drum flange assembly 501 is inserted into the photosensitive drum 7. Further, the contact point 75*a* of the drum grounding plate 70 makes contact with the center portion of the end of the electrically conductive shaft 42*b* (FIG. 4), and therefore, the wearing of the contact point 75*a* is minimized. Further, the flat portion 701 of the drum grounding plate 70 is firmly held to the drum flange 70 by the clamping plate 90, being prevented from deforming, and therefore, it is assured that the elastic arm portion 75 reliably generates a pressure of 50 g–100 g.

Further, according to the present invention, the number of the bosses of the drum flange 50 is eight, or the most appropriate number, so that the stress generated in the drum grounding plate 70 when the cylinder clamping pawls 91*a*–91*h* are pressed is borne by the drum flange clamping pawls 92*a*–92*h*, preventing thereby the bosses 54*a*–54*h* from being damaged.

In this embodiment, the drum flange 50 is provided with eight bosses 54*a*–54*h*. However, it may be provided with only two bosses. In such a case, the two bosses are symmetrically positioned relative to the longitudinal central axis of the photosensitive drum 7, and the clamping plate 90 is easily held to the drum flange 50 by melting the symmetrically positioned bosses.

Figure 18:
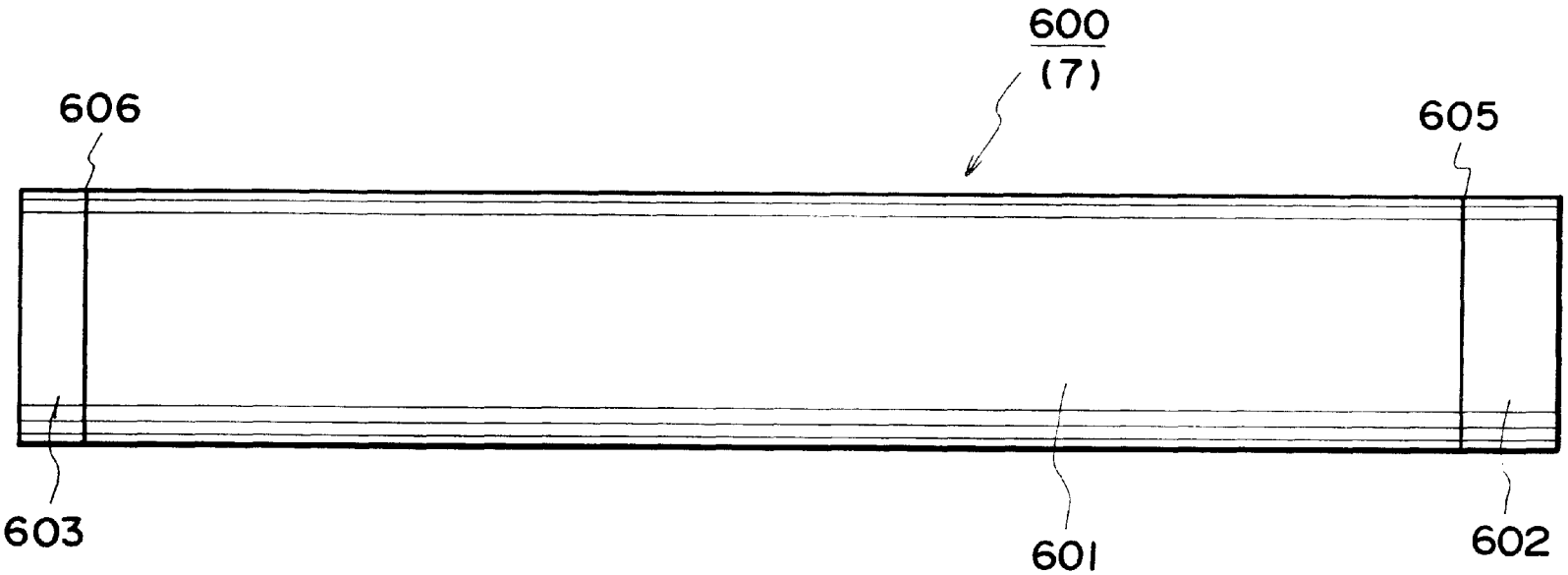
FIG. 18 is a front view showing a painted surface of the photosensitive drum.

FIG. 18 is a front view of the photosensitive drum 7, in particular, the coated peripheral surface thereof.

In FIG. 18, a reference character 600 designates a hollow aluminum cylinder which constitutes the base member of the photosensitive drum 7. The photosensitive layer is coated on the peripheral surface of this aluminum cylinder 600.

A reference character 601 designates the photosensitive layer portion (image bearing portion) on the aluminum cylinder 600, and reference characters 602 and 603 each designate a portion of the aluminum cylinder where the peripheral surface of the aluminum cylinder 600 is exposed.

One of the commonly used methods for coating the photosensitive drum 7 is as follows. The aluminum cylinder 600 is dipped in a pot (unillustrated) which contains a melted photosensitive layer material, so that the aluminum cylinder 600 is dipped as deep as a line 605 between the coated and uncoated areas illustrated in FIG. 18. Then, the photosensitive material having adhered to the inside surface of the aluminum cylinder 600 is removed by solvent, a blade (unillustrated), or the like.

Next, the photosensitive material having adhered to the outside of the aluminum cylinder 600 is removed from the end portion opposite to the end portion covered with the photosensitive material, up to the line 606 between the portion 603 and the photosensitive layer portion 601, by a blade or the like.

Hereinafter, a method for assembling the drum unit 7*b* will be described.

Figure 21:
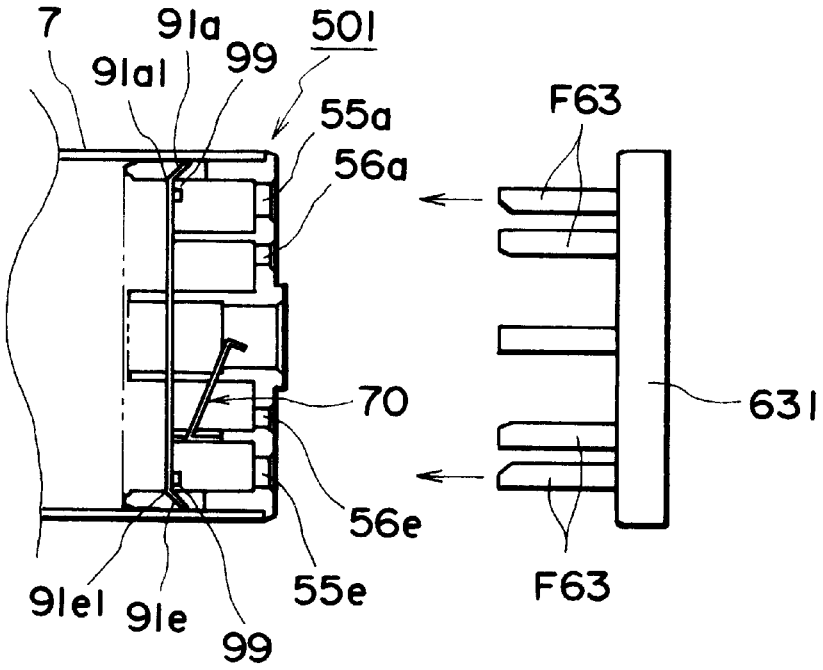
FIG. 21 is an illustration when a cylinder clamping pawl of a clamping plate is inserted by a pawl pushing tool.

The order in which the drum unit 7*b* is assembled is as follows. First, the drum flange assembly 501 is inserted into the photosensitive drum 7 (FIG. 21). Next, the cylinder clamping pawls 91*a*–91*h* of the clamping plate 90 are bent toward the center of the photosensitive drum 7 with the use of a pressing tool 631.

FIG. 19 is a drawing which shows the dimensional relationship between the drum flange assembly 501 and photosensitive drum 7.

The dimensional relationship between the internal diameter D707 of the photosensitive drum 7, and the measurements of the flange assembly 501 to be pressed into the photosensitive drum 7, is as follows. The external diameter D501 of the portion 51 of the drum flange 50 is 1.0005–1.005 times the internal diameter D707 of the photosensitive drum 7, and the external diameter D502 of the fitting portion 52 of the drum flange 50 is 0.999–1.002 times the internal diameter D707 of the photosensitive drum 7. The external diameter D503 of the fitting guide portion 53 of the drum flange 50 is perfectly matched with the internal diameter D707 of the photosensitive drum 7 so that the fitting guide portion 53 perfectly fits in the photosensitive drum 7, that is, without any gap.

The fitting portion 52 of the drum flange 50 is provided with an edge 52*b*, which is on the fitting guide portion 53 side of the drum flange 50 (FIG. 5).

The relationship among the external diameters D501, D502 and D503 of the fitting portions 51 and 52, and fitting guide portion 53, respectively, of the drum flange 50, and the internal diameter D707 of the photosensitive drum 7, in terms of the central value within a tolerance range is:

D501>D502>D707>D503.

Further, the external diameter D501 of the portion 51 of the drum flange 50 is definitely larger in terms of the central value in the tolerance range than the internal diameter D707 of the photosensitive drum 7.

The external diameter D503 of the fitting guide portion 53 is definitely smaller in terms of the central value in the tolerance range than the internal diameter D707 of the photosensitive drum 7.

The external diameter D502 of the portion 52 is larger than the internal diameter D707 of the photosensitive drum 7, only in terms of the central value within the tolerance range. Thus, some gap may be present between the portion 52 and the inside surface of the photosensitive drum 7 after the insertion of the drum flange 50 into the photosensitive drum 7.

Figure 20:
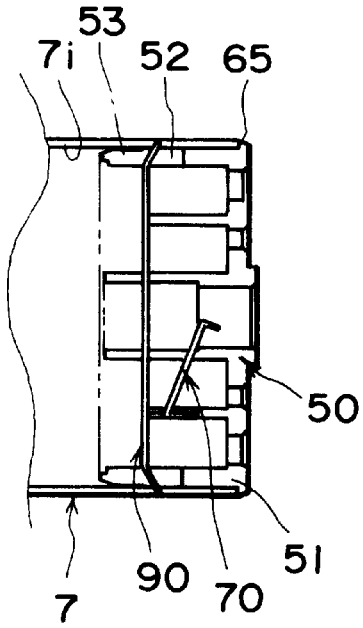
FIG. 20 shows the drum flange inserted into the photosensitive drum.

FIG. 20 is a sectional view of the drum flange assembly 501 after its insertion into the photosensitive drum 7.

In this embodiment, the drum flange assembly 502, complete with clamping plate 90, is inserted into the photosensitive drum 7, on the side 602 where the aluminum cylinder is exposed.

As the drum flange assembly 501 is inserted into the photosensitive drum 7, the insertion stopper 65 of the drum flange 50 functions to stop the insertion of the drum flange assembly 502, accurately positioning the drum flange assembly 502 relative to the photosensitive drum 7 in terms of the longitudinal direction of the photosensitive drum 7.

FIG. 21 is an explanatory drawing which depicts how the cylinder clamping pawls 91*a*–91*h* of the clamping plate 90 are inserted into the photosensitive drum 7 up to the predetermined positions with the use of the pressing tool 631.

Figure 23:
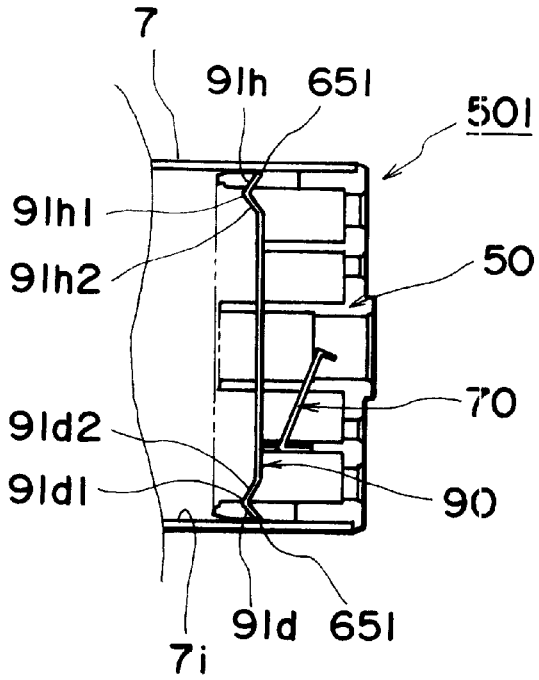
FIG. 23 is a sectional view of a drum flange mounted to the photosensitive drum 7.

The pressing tool 631 presses the cylinder clamping pawls 91*a*–91*h* of the clamping plate 90, on the pressure application points 99 located adjacent to the base portions of the extensions 91*a*–91*h*, by its pressing prongs F63, until the extensions 91*a*–91*h* settle in the positions illustrated in FIG. 23, at which they are caused to firmly grip the photosensitive drum 7. With the extensions 91*a*–91*h* settled in the positions illustrated in FIG. 23, the contact points 651 between the extensions 91*a*–91*h* and the photosensitive drum 7 are substantially the same as the location of the edge 52*a* of the fitting portion 52 of the drum flange 50. As the cylinder clamping pawl 91*a*–91*h* are pressed inward the photosensitive drum 7, the photosensitive material layer adhering to the inside surface of the photosensitive drum 7 is scraped away by them.

With the structure described above, the cylinder clamping pawls 91*a*–91*h* and the edge 52*a* of the fitting portion 52 of the drum flange 50 press upon the photosensitive drum 7 from inside, minimizing the loss of the circularity of the photosensitive drum 7 caused by the cylinder clamping pawls 91*a*–91*h*.

Further, the extensions 92*a*–92*h* are tilted toward the longitudinal center (inward) of the photosensitive drum 7 relative to the inside surface 52*b* of the fitting portion 52. Therefore, pressing UA the cylinder clamping pawls 91*a*–91*h* causes the drum clamping pawls 92*a*–92*h* to push the fitting portion 52 in the radially outward direction, creating the synergistic effect of preventing the circularity of the photosensitive drum 7 from being adversely affected.

Further, the extensions 91*a*–91*h* tilt outward of the photosensitive drum 7, that is, in the direction opposite to the extensions 92*a*–92*h*, in terms of the longitudinal direction of the photosensitive drum 7. Therefore, the synergistic effect is created also in terms of their resilient force generated by being elastically deformed, increasing the force with which the extensions 91*a*–91*h* grip the photosensitive drum 7. In other words, the above described structure improves reliability.

Figure 22:
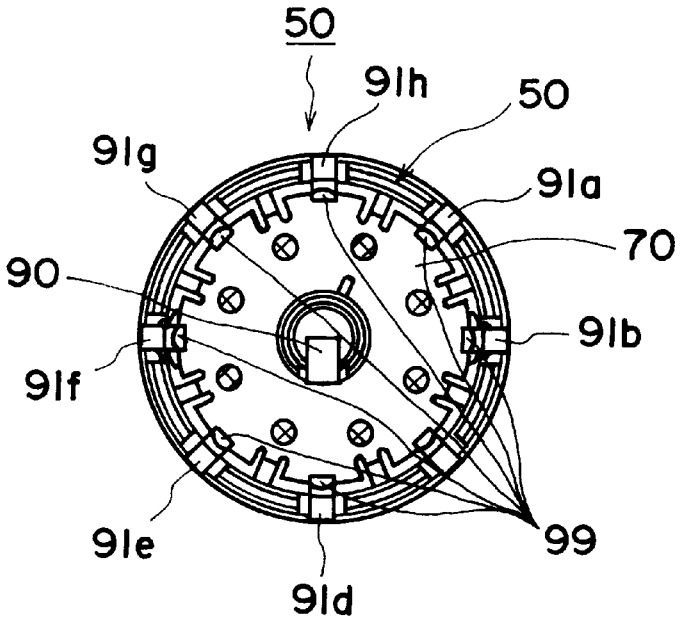
FIG. 22 shows a drum flange as seen from the center of the photosensitive drum toward outside.

FIG. 22 is a view of the drum flange assembly 501 as seen from the inward side of the photosensitive drum 7.

In FIG. 22, the pressing points 99 of the cylinder clamping pawls 91*a*–91*h* of the clamping pate 90, which are pressed by the pressing tool 631, are illustrated as if they are on the same plane as the plane of this drawing. The pressing prongs F63 of the pressing tool 631 press the back side (in this drawing) of the clamping plate 90 toward the longitudinal center of the photosensitive drum 7. The pressing points 99 are located at the approximate centers of the extensions 91*a*–91*h* in terms of the radial direction of the clamping plate 90, and outward of the circles drawn through the bosses 54*a*–54*h*, in terms of the radial direction of the clamping plate 90.

With the above arrangement, the extensions 91*a*–91*h* can be bent perpendicularly to the direction in which they are inserted. Therefore, the photosensitive drum 7 is better in circularity, and the drum flange assembly 501 is more reliably clamped to the photosensitive drum 7.

Further, as the clamping plate 90 is pressed by the pressing tool 631, on the pressing points 99, the cylinder clamping pawls 91*a*–91*h* are bent at points 91*a*2–91*h*2 (FIG. 23) which are adjacent to the original bent points 91*a*1–91*h*1 (FIG. 21).

FIG. 23 is a sectional view of the drum flange assembly 501 after its insertion into the photosensitive drum 7.

The cylinder clamping pawls 91*a*–91*h* of the clamping plate 90 contact the inside surface 7*i* of the photosensitive drum 7, at the points 651, being bent as illustrated in FIG. 23. These points 651 correspond to the border line 606 between the portion 603 where the aluminum cylinder is exposed, and the photosensitive layer portion, on the outer surface of the photosensitive drum 7. At these points 651, the circularity of the photosensitive drum 7 is not a serious concern. Therefore, the drum unit 7*b* is improved in yield. In other words, productivity is improved along with quality.

Figure 24:
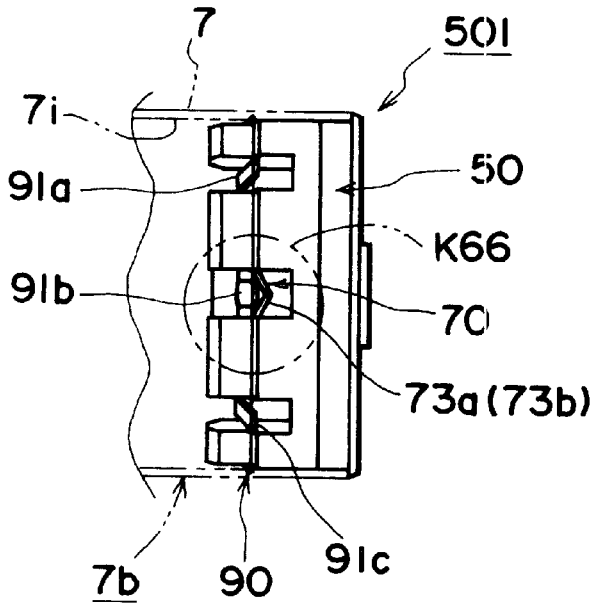
FIG. 24 is a side view showing a relation between the clamping plate and the grounding plate in the drum flange after assembling.

FIG. 24 is a side view of the assembled drum unit 7*b*. It depicts the relationship between the clamping plate 90 and drum grounding plate 70. More specifically, it is a transparent view of the assembled drum unit 7*b*, and shows the state of the drum flange assembly 501 in the completed drum unit 7*b*, through the photosensitive drum 7.

As the pressing tool 631 illustrated in FIG. 21 is pressed, the cylinder clamping pawls 91*a*–91*h* of the clamping plate 90 come in contact with the inside surface 7*i* of the photosensitive drum 7, and wedge themselves against the inside surface 7*i*, on the spots away from the contact points 73*a* and 73*b* of the drum grounding plate 70.

Figure 25:
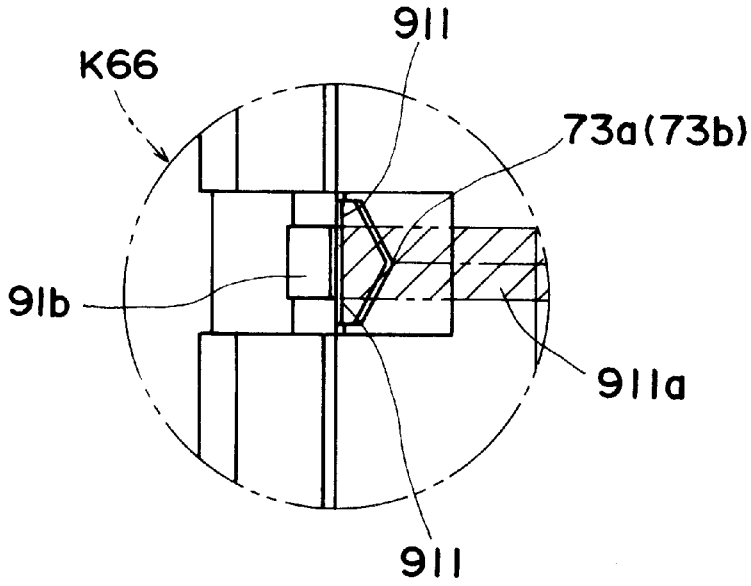
FIG. 25 is a detailed illustration showing a relation between the clamping plate and the grounding plate.

FIG. 25 is an enlarged view of the portions of the clamping plate 90 and drum grounding plate 70, and shows in detail the relationship between the clamping plate 90 and drum grounding plate 70 illustrated in FIG. 24, in particular, the portions designated by a reference character K66 in FIG. 24. It depicts the contact points 73*a* and 73*b* of the drum grounding plate 70, and the cylinder clamping pawls 91*a*–91*h* of the clamping plate 90.

Referring to FIG. 12, the cylinder clamping pawls 91*a*–91*h* of the clamping plate 90 have a square tip. Further, the clamping plate 90 is formed of electrically conductive material, and therefore, the square edge portions 911 of the tips of the extensions 91*a*–91*h* further assure reliability in terms of electrical conductivity. Also, as the clamping plate 90 is pressed, the distance between the edge portions 911 of the extensions 91*a*–91*h* and the contact points 73*a* and 73*b* of the drum grounding plate 70 increases, increasing thereby the size of the contact area. Therefore, the reliability of the electrical contact points is drastically improved. In addition, the extensions 91*a*–91*h* reliably bite into the inside surface of the photosensitive drum 7, further improving electrical conductivity. The area 911*a* covered with diagonal lines is the area from which the photosensitive material layer adhering to the inside surface 7*i* of the photosensitive drum 7 has been scraped away by the cylinder clamping pawls 91*a*–91*h* of the clamping plate 90.

Figure 26:
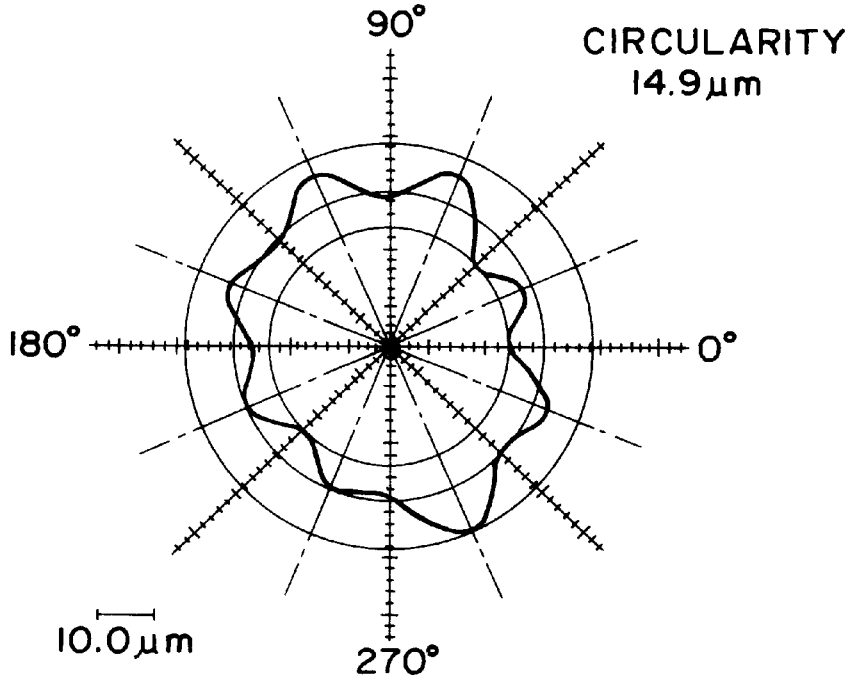
FIG. 26 illustrates the deterioration of circularity of the photosensitive drum when there is no press-fitting engagement portion, nor flange clamping pawl of the clamping plate.

FIG. 26 shows the deterioration of the circularity of the photosensitive drum 7 when the flange 501 does not have the clamping pawls 92*a*–92*h* and the engaging portion 52. The thickness of the cylinder wall is 1 mm.

In FIG. 26, the contact portion between the photosensitive drum 7 and the pawls 91*a*–91*h* of the clamping plate 90 is indicated by a chain line. As will be understood from the figure, the outer surface is not smooth, and the circularity is 14.9 $\mu$m.

Figure 27A:
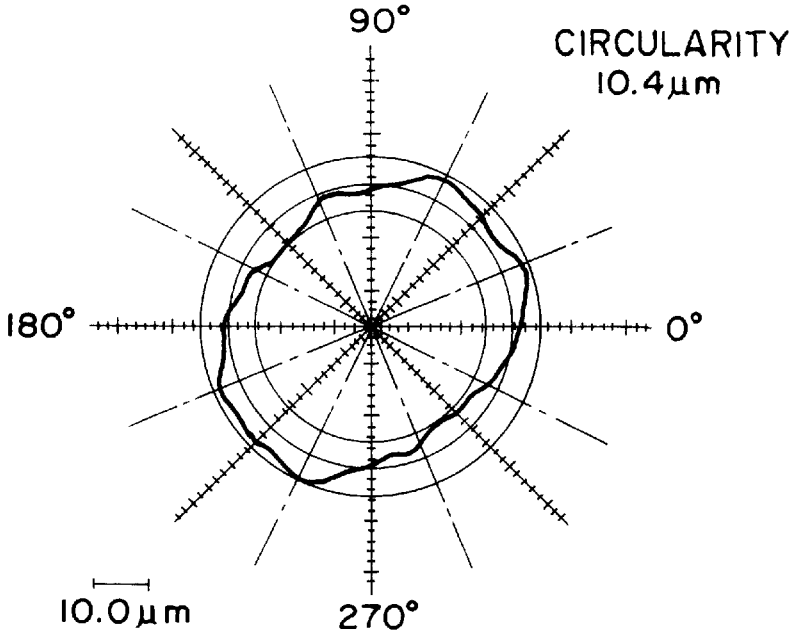
FIG. 27 shows a circularity of the photosensitive drum when the drum flange according to the present invention is used, wherein (a) shows an outer diameter circularity of the photosensitive drum at the position where a flange clamping pawl of the clamping plate contacts to the photosensitive drum, (b) shows an outer diameter circularity of the photosensitive drum at a position approximately 3 mm away from the position where the flange clamping pawl of the clamping plate contacts to the photosensitive drum.
Figure 27B:
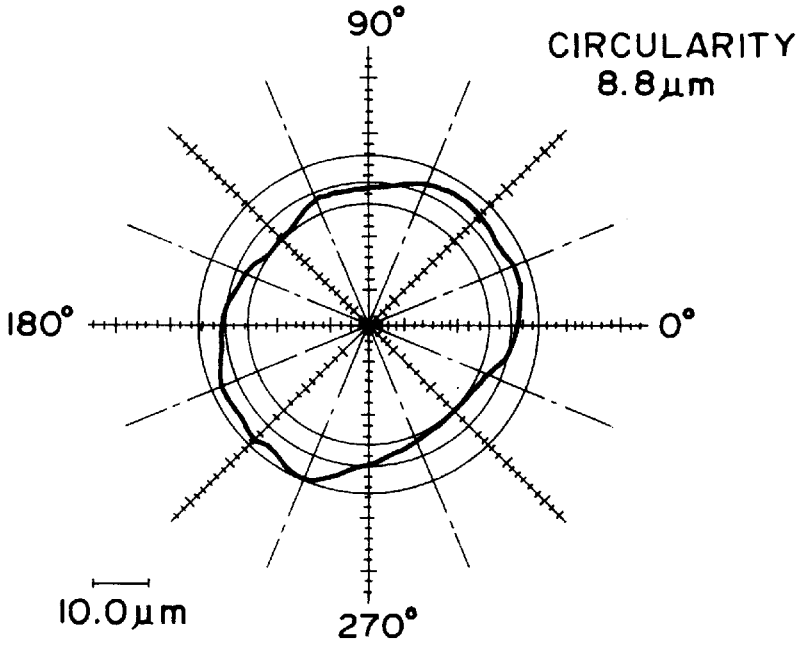

FIG. 27 shows the circularity of the photosensitive drum 7 using the drum flange 501 according to this embodiment. (a) shows the outer diameter circularity of the photosensitive drum at the position where the pawl 92*a*–92*h* of the clamping plate 9 contacts to the photosensitive drum 7, and (b) shows the outer diameter circularity of the photosensitive drum 7 at the position approximately 3 mm away from the position where the pawls 92*a*–92*h* of the clamping plate 90 contacts to the photosensitive drum.

In (a) of FIG. 27, chain line indicates the contact portion between the clamping plate 90 of the photosensitive drum and the pawls 91*a*–91*h*. As will be understood from the figure, the outer surface of the photosensitive drum 7 is smooth, and the circularity is 10.4 $\mu$m because of the provision of the engaging portion 52 of the body 50 of the flange and the pawls 92*a*–92*h* of the clamping plate 90.

In (b) of FIG. 27, chain line indicates the contact portion between the clamping plate 90 of the photosensitive drum and the pawls 91*a*–91*h*. As will be understood from the figure, the influence of the pawls 91*a*–91*h* of the clamping plate 90 is removed, and the circularity is 8.8 $\mu$m.

Although not shown here, the contact position of the pawls 91*a*–91*h* of the clamping plate 90 to the photosensitive drum 7 is between an abutment reference position for a spacer for maintaining a gap between the photosensitive drum 7 and the developing roller(developing means) 10*c* and a printing region (photosensitive layer portion 601 of the aluminum cylinder 600, as described above), and is away from the abutment reference position by not less than 3 mm, and is away from the printing region by not less than 15 mm.

By doing so, the yield of the drum unit 7*b* is raised, and the image quality of the formed image is improved, so that quality and productivity of the drum unit 7*b* is improved.

(Another Embodiment of the Drum Flange)

Figure 28:
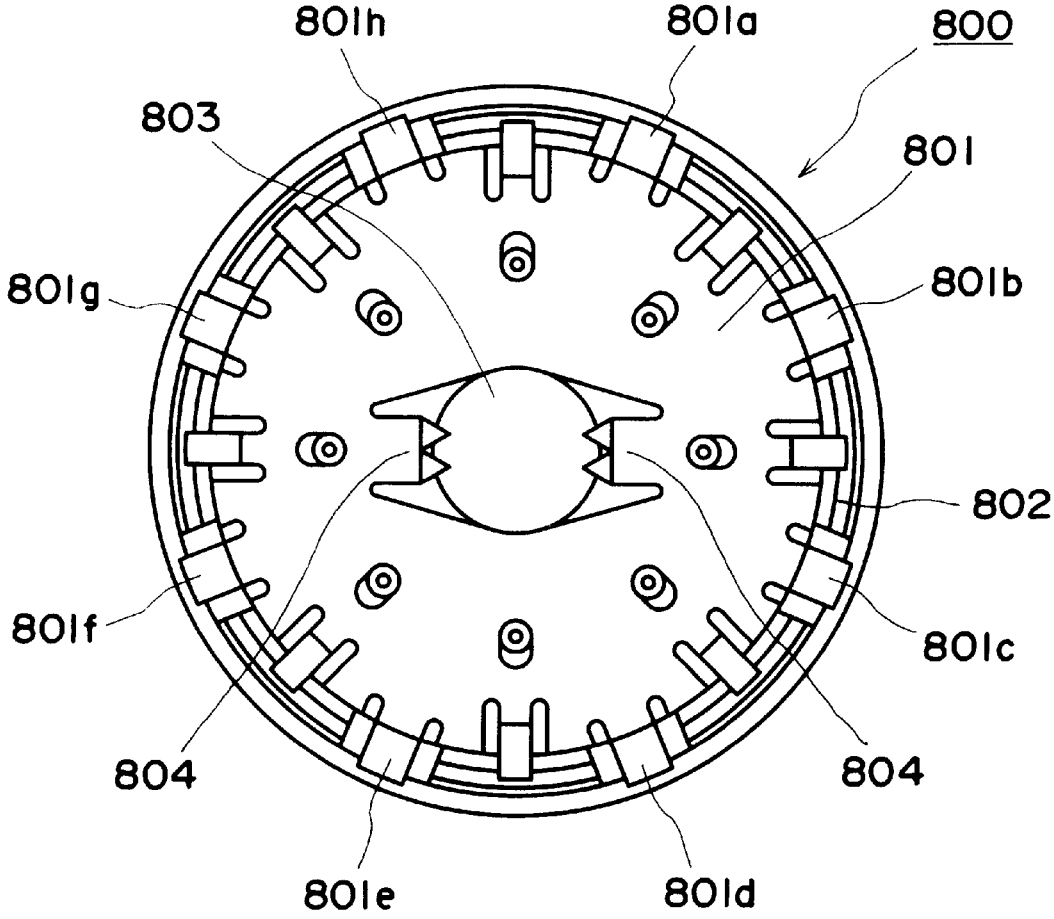
FIG. 28 is a front view of a drum flange according to another embodiment of the present invention.
Figure 29:
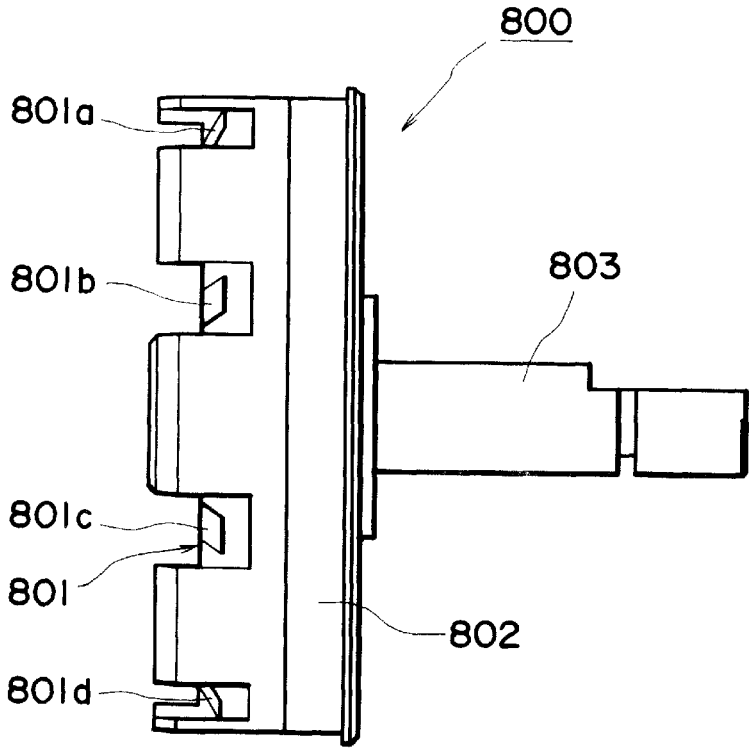
FIG. 29 is a side view of a drum flange shown in FIG. 28.

FIG. 28 is a front view of an above-described drum flange 501 according to another embodiment of the present invention, and FIG. 29 a side view of a drum flange shown in FIG. 28.

In FIGS. 28 and 29, designated by 801 is an electroconductive clamping plate of stainless steel, Sphosphor bronze or the like having a structure similar to that of the clamping plate 90; 802 is a body of the drum flange press-fitted into the end of the photosensitive drum 7; 803 is an electroconductive center shaft of SUS (stainless steel) or the like unified with the body 802 of the drum flange by insertion molding or the like; 804 is a radial pawl-as a third pawl radially extended from the clamping plate 801 toward the inside of the circle. The flange 800 of this embodiment, similarly to the drum flange 501 of the above-described embodiment, assuredly contacts the inner wall 7*i* of the photosensitive drum 7, by the cylinder clamping pawls 801*a*–801*h* of the clamping plate 801, by way of the conduction shaft 803 from the ground portion of the main assembly of the printer (not shown), which is contacted to the electroconductive center shaft 803.

By this, there is no need to provide a grounding plate 70 as in the drum flange 501 of the above-described embodiment, so that number of parts is reduced, and the assembling property is improved with cost reduction and improved quality.

(Another Embodiment of Clamping Plate)

Figure 30:
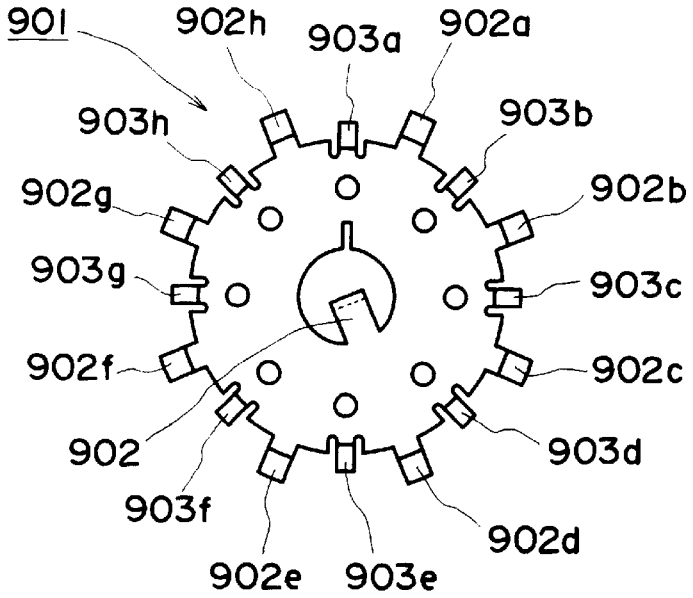
FIG. 30 is a front view of a clamping plate according to another embodiment of the present invention.

FIG. 30 is a front view of a clamping plate 90 according to another embodiment of the present invention.

In this embodiment, the clamping plate 901 is of electroconductive material such as bronze, stainless steel or the like. The structure is the same as with the clamping plate 901 of the above-described embodiment except that grounding contact 902 is constituted by a center portion of the engaging hole 901*a* of the conduction shaft 42*b*. In this figure, designated by 902*a*–902*h* are cylinder clamping pawls; and 903*a*–903*h* are flange clamping pawls.

With such structure, similar to the drum flange 501 of the above-described embodiment, there is no need to provide the drum grounding plate 70, so that so that number of parts of the drum flange 501 is reduced, and the assembling property is improved with a cost reduction and improved quality.

As described in the foregoing, according to this embodiment, each of the pawls 91*a*–91*h* of the clamping plate 90, secured to the fixing of the engaging portion 51 of the body 50, is provided with bent portion 91*a*2–91*h*2 elastically bent toward the longitudinally central portion (inside) of the photosensitive drum 7, and bites into the inner surface of the wall of the photosensitive drum 7. Additionally, it urges the body 50 of the flange toward the longitudinally central portion of the photosensitive drum 7. By this, the connection force between the body 50 of the flange and the photosensitive drum 7 is made firmer, thus improving the quality of the drum unit 7*b*.

By limiting the diameter D901 of the circumscribed circle of the pawls 91*a*–91*h* of the clamping plate 90 such that lengths of the pawls 91*a*–91*h* are within the range of 1.01–1.05 times the inner diameter D707 of the photosensitive drum 7, the productivity of the clamping plate 90 is improved, and the connection strength relative to the photosensitive drum 7 is assured, and therefore, the quality of the drum unit 7*b* and the productivity are improved.

By provision of through-holes 55*a*–55*h* in the circular disk surface 62 of the body 50, corresponding to the pawls 91*a*–91*h* of the clamping plate 90, it can be inspected whether the pawls 91*a*–91*h* of the clamping plate 90 are bent assuredly, that is, whether the connection with the photosensitive drum 7 is satisfactory, so that the quality of the drum unit 7*b* can be improved.

By using eight pawls 91*a*–91*h* in the clamping plate 90, the expansion in the radially outward direction can be distributed properly, so that circularity of the photosensitive drum 7 is improved, and therefore, the image quality of the formed image and the quality of the drum unit 7*b* are improved.

By using a tool 631 through through-holes 55*a*–55*h* formed in the circular disk surface 62 of the body 50 of the drum flange, the pawls 91*a*–91*h* of the clamping plate 90 can be assuredly and easily bent, and therefore, the mass-productivity and the quality of the drum unit 7*b* can be improved.

The body 50 of the drum flange is made of resin material having a low melting point, and the clamping plate 90 is made of a material having a high melting point such as stainless steel, phosphor bronze or the like. At least two bosses 54*a*–54*h* provided in the body 50 of the drum flange are engaged in the holes 95*a*–95*h* of the clamping plate 90, and are melted and solidified. Because of these features, the clamping plate 90 can be easily fastened relative to the body 50 of the drum flange, and the mass-productivity and a cost reduction of the drum flange 501 can be accomplished.

At least two bosses 54*a*–54*h* of the body 50 of the drum flange are disposed at a line symmetrical position, that is, equidistant from the center line 91*o* of the pawls 91*a*–91*h*, respectively, by which twisting of the pawl 91*a*–91*h* upon elastic deformation can be suppressed, and the connection relative to the photosensitive drum 7 can be stabilized, and therefore, the quality of the drum unit 7*b* can be improved.

At least two bosses 54*a*–54*h* of the body 50 of the drum flange are disposed outside the width of the pawl 91*a*–91*h* of the clamping plate 90, and are opposed to the center line 91*o* of the pawls 91*a*–91*h*, by which the twisting of the pawls 91*a*–91*h* upon the elastic deformation can be further suppressed, and the connection relative to the photosensitive drum 7 is further stabilized, and therefore, the quality of the drum unit 7*b* can be improved.

By using not less than 8 bosses 54*a*–54*h*, the connection of the pawl 91*a*–91*h* of the clamping plate 90 relative to the photosensitive drum 7 is stabilized, and the mass-productivity and the quality of the drum unit 7*b* is improved, and cost reduction is accomplished.

The engaging portion 51 of the body 50 of the flange is provided with an engaging portion 52, and is provided with cut-away portions 60*a*–60*h* for contacting the pawls 91*a*–91*h* of the clamping plate 90 to the inner wall 7*i* of the photosensitive drum 7, and the pawls 91*a*–91*h* of the clamping plate 90 are mounted to the inner wall 7*i* of the photosensitive drum 7 at a position of the edge portion 52*a* of the engaging portion 52 of the body 50 of the drum flange. By this, the pawls 91*a*–91*h* and the engaging portion 52 are pressed to the photosensitive drum 7. Therefore, the pressing force applies uniformly to the photosensitive drum 7, so that deterioration of the circularity of the photosensitive drum 7 is suppressed, and the image quality of the formed image and the quality of the drum unit 7*b* are improved.

The outer diameter D501, D502 of the engaging portion 51 and the engaging portion 52 of the body 50 of the flange is within the range of 0.999 times–1.005 times of the inner diameter D707 of the photosensitive drum 7, so that mass-productivity property of the drum unit 7*b* and the quality of the drum unit 7*b* can be improved.

The pawls 92*a*–92*h* of the clamping plate 90 are bent toward the central portion (inside) to contacts the inner wall 52*b* of the engaging portion 52 of the body 50 of the flange, and the pawls 91*a*–91*h* of the clamping plate 90 are pressed toward the center side of the photosensitive drum 7. By doing so, the pawls 92*a*–92*h* press against the inner wall 7*i* of the photosensitive drum 7 through the inner wall 52*b* of the engaging portion 52. Thus, the connecting force between the drum flange 501 and the photosensitive drum 7 are further improved, and the deformation of the clamping plate 90 per se by the pawls 91*a*–91*h*, can be suppressed, the deterioration of the circularity of the photosensitive drum 7 can be further suppressed, and the quality of the drum unit 7*b* and the image quality can be further improved.

The pawls 92*a*–92*h* of the clamping plate 9 are disposed adjacent the at least two bosses 54*a*–54*h* of the body 50 of the flange. By doing so, the force in the direction of urging the pawls 91*a*–91*h* toward the longitudinally inside of the photosensitive drum 7 (inside), is received by the pawls 92*a*–92*h*. Therefore, the load applied on the at least two bosses 54*a*–54*h* of the body 50 of the flange can be reduced, so that the heat crimp boss is not easily broken, and therefore, the mass-productivity property of the drum unit 7*b* and the quality of the drum unit 7*b* can be improved.

By using 8 pawls 92*a*–92*h* for the clamping plate 90, the number of the pawls 91*a*–91*h* which directly urge the photosensitive drum 7, and the number of the pawls 92*a*–92*h* which urge the photosensitive drum 7 through the inner wall 52*b* of the engaging portion 52 of the body 50 of the flange, can be increased. Therefore, the circularity of the photosensitive drum 7 can be improved, and the number of the bosses 54*a*–54*h* of the engaging portion 52 of the body 50 of the flange can be minimized, so that the connection with the photosensitive drum 7 can be stabilized, and the drum-unit mass-productivity and the quality of the drum unit 7*b* are improved, and the cost reduction can be accomplished.

The center portions (widthwise) of the pawls 91*a*–91*h* of the clamping plate 90 are deformed and bent toward the longitudinally inside (inside) of the photosensitive drum 7 by bosses 54*a*–54*h* of the body 50 of the flange, using a tool 631. By this, the pawls 91*a*–91*h* are easily deformed elastically without twisting, and therefore, the drum-unit mass-productivity and quality are improved.

The contact portions between the drum and the pawls 91*a*–91*h* of the clamping plate 90, which may cause the circularity of the photosensitive drum 7 to deteriorate, are disposed adjacent the coating boundary portion 606 between the image carrying portion 601 and the metal exposed portion 603, which does not require high accuracy. Therefore, a cause of deterioration of the circularity of the photosensitive drum 7 can be avoided, and the drum-unit mass-productivity and quality can be improved, and the image quality of the formed image can be improved.

The contact portions between the clamping plate 90 and the cylinder clamping pawl 91*a*–91*h*, which may cause the circularity of the photosensitive drum 7 to deteriorate, are sufficiently away from the abutment portion, which is a contact reference between the image region(printing region 601) of the photosensitive drum 7 and the developing roller 10*c*, by which the quality of the drum unit 7*b* and the image quality of the formed image can be improved.

As described with respect to another embodiment of the drum flange, when the body 802 of the flange is integrally formed with the electroconductive center shaft 803, the clamping plate 801 is made electroconductive. By doing so, the grounding plate is not required, and a sufficient connection force and assured electroconduction can be accomplished, so that assembling operativity, product quality and the mass-productivity are improved.

By using an electroconductive material as the material of the clamping plate 90, electroconduction with the conduction shaft 42*b* is improved, and the quality of the drum unit 7*b* is improved.

By using a stainless steel plate, and phosphor bronze, which are readily available, as the material of the clamping plate 90, a drum unit 7*b* which is inexpensive, highly reliable, and which has high quality, can be provided.

[Other Embodiments].

In the foregoing embodiments, a description has been provided with respect to the drum flange used for the electrophotographic photosensitive member as a cylindrical member, but the drum flange of the present invention is preferably usable for a developing roller of a developing means wherein the circularity is improved. Therefore, the cylindrical member in the present invention includes a developing roller as well as the photosensitive drum.

Further, the process cartridge B in the first embodiment was of a type which formed a monochromatic image. However, the present invention is preferably applicable not only to a process cartridge which forms a monochromatic image, but also to a process cartridge which comprises multiple developing means and forms a multi-color image (for example, two-color image, three-color image, or full-color image).

Also, the electrophotographic photosensitive member is not limited to the photosensitive drum alone. For example, the following may be included. First, as for the photosensitive material, photoconductive material such as amorphous silicon, amorphous selenium, zinc oxide, titanium oxide, or organic photoconductive material may be included. As for the configuration of the base on which the photosensitive material is coated, a rotary configuration, such as a drum shape, or a flat configuration, such as a belt shape, may be included.

Also, the present invention is preferably usable with various known developing methods such as the magnetic brush developing method using two component toner, the cascade developing method, the touch-down developing method, the cloud developing method.

The structure of the charging means has been described as a contact charging method, but a conventional structure is usable wherein a tungsten wire is enclosed by a metal shield of a material such as aluminum at three sides, and a high voltage is applied to the tungsten wire to generate positive or negative ions, which are sent to the surface of the photosensitive drum, thus uniformly charging the surface of the drum.

Further, the charging means may be of a blade type (charge blade), a pad type, a block type, a rod type, or a wire type, in addition to the aforementioned roller type.

The means for cleaning the toner remaining on the photosensitive drum may be of a blade type, a fur brush type, a magnetic brush type, or the like.

The process cartridge may be the one containing the electrophotographic photosensitive member, the developing means and at least one of process means for example. Therefore, the process cartridge may be the ones disclosed as the embodiment, the one containing the electrophotographic photosensitive member, the developing means and the charging means as a unit which is detachably mountable relative to the image forming apparatus, the one containing the electrophotographic photosensitive member, the developing means, and the cleaning means as a unit, which is detachably mountable relative to the image forming apparatus, or the one containing the electrophotographic photosensitive member and the developing means, as a unit, which is detachably mountable relative to the image forming apparatus, for example.

In the description of the embodiments, the laser beam printer is discussed, but the present invention is not limited to this, and is usable with an electrophotographic copying machine, a facsimile machine, a word processor, or another electrophotographic image forming apparatus.

As described in the foregoing, according to the present invention, there is provided a drum flange having a plurality of pawls in the form of elastic plate members fixed to a press-fitting engagement portion of the body, and each of the pawls is elastically deformed toward a longitudinally central portion (inside) of the cylindrical member to form bent portions, which bite in the inner wall of the cylindrical member. By this, the body of the flange is urged toward the center side in the longitudinal direction of the cylindrical member, so that the connecting force between the flange body and the cylindrical member are made firmer. According to the cylindrical member of the embodiments of the present invention, there is provided a flange having a plurality of pawls in the form of an elastic plate members fixed to a press-fitting engagement portion of the body, and each of the pawls is elastically deformed toward a longitudinally central portion (inside) of the cylindrical member to form bent portions, which bite in the inner wall of the cylindrical member By this, the body of the flange is urged toward the center side in the longitudinal direction of the cylindrical member, so that the connecting force between the flange body and the cylindrical member is firm enough to survive high speed rotation, and a long service life.

For process cartridge having a drum flange of an electrophotographic photosensitive drum supported on a cartridge frame, there is provided a drum flange having a plurality of pawls in the form of elastic plate members fixed to a press-fitting engagement portion of the body, and each of the pawls is elastically deformed toward a longitudinally central portion (inside) of the electrophotographic photosensitive member to form bent portions, which bite in the inner wall of the electrophotographic photosensitive member. By this, the body of the flange is urged toward the center side in the longitudinal direction of the electrophotographic photosensitive drum, so that the connecting force between the flange body and the electrophotographic photosensitive drum is firm enough to survive high speed rotation, and a long service life.

As described in the foregoing, according to the present invention, the flange can be clamped to a cylindrical member assuredly.

While the invention has been described with reference to the structures disclosed herein, it is not confined to the details set forth and this application is intended to cover such modifications or changes as may come within the purposes of the improvements or the scope of the following claims.

What is claimed is:

1. A mounting member for mounting a flange to an end of a cylindrical member of an electrophotographic photosensitive drum, comprising:

a base plate;

a hole provided at a center portion of said base plate;

a plurality of first extensions projecting outwardly from an edge of said base plate, for elastic contact to an inner surface of said flange when said mounting member is mounted to the flange;

a plurality of second extensions projecting outwardly from an edge of said base plate, for elastic contact to an inner surface of said cylindrical member when said flange is mounted to said cylindrical member, wherein said second extensions project further outward than said first extensions.

2. A mounting member according to claim 1, wherein said first extensions and said second extensions are alternately provided, and are extended radially.

3. A mounting member according to claim 2, wherein said first extensions are bent in a free state.

4. A mounting member according to claim 2, wherein said second extensions are bent in a free state, and said first extensions and said second extensions are bent in different directions.

5. A mounting member according to claims 1, 2, 3 or 4, wherein a plurality of mounting holes are disposed around said hole provided at the center portion of said base plate to fix said mounting member to said flange.

6. A mounting member according to claim 1, wherein when an electrophotographic photosensitive drum is mounted to a frame of a process cartridge, said hole receives a shaft for rotatably supporting said electrophotographic photosensitive drum on said frame.

7. A mounting member according to claims 1, 2, 3, 4, or 6, wherein said mounting member is a metal plate.

8. A mounting member according to claim 1, wherein said base plate is circular in shape, wherein when an electrophotographic photosensitive drum is mounted to a frame of a process cartridge, said hole receives a shaft for rotatably supporting said electrophotographic photosensitive drum, and said first extensions and said second extensions are alternately provided, wherein said first extensions and said second extensions are radially extended, and wherein said mounting member is a metal plate.

9. A mounting member for mounting a flange to an end of a cylindrical member of an electrophotographic photosensitive drum, comprising:

a substantially circular base plate;

a hole provided at a center portion of said base plate, wherein when a electrophotographic photosensitive drum is mounted to a frame of a process cartridge, said hole receives a shaft for rotatably supporting said electrophotographic photosensitive drum;

a plurality of first extensions projecting outwardly from an edge of said base plate, for elastic contact to an inner surface of said flange when said mounting member is mounted to the flange;

a plurality of second extensions projecting outwardly from the edge of said base plate, for elastic contact to an inner surface of said cylindrical member when said flange is mounted to said cylindrical member;

wherein said first extensions and said second extensions are alternately provided, and are extended radially, wherein said second extensions project further outward than said first extensions, and wherein said base plate, said first extensions and said second extensions are composed of metal.

10. A mounting member according to claim 9, wherein said first extensions are bent in a free state.

11. A mounting member according to claim 10, wherein said second extensions are bent in a free state, and said first extensions and said second extensions are bent in different directions.

12. A mounting member according to claims 9, 10 or 11, wherein a plurality of mounting holes are disposed around said hole provided at the center portion of said base plate to fix said mounting member to said flange.

13. A flange assembly to be mounted to an end of an electrophotographic photosensitive drum, comprising:

a. a flange having an engaging portion for engagement to an end of a cylindrical member of the electrophotographic photosensitive drum;

b. a mounting member which is mounted to said flange and which includes:

a base plate;

a hole provided at a center portion of said base plate;

a plurality of first extensions projecting outwardly from an edge of said base plate and elastically contacting an inner surface of said flange;

a plurality of second extensions projecting outwardly from an edge of said base plate, for elastic contact to an inner surface of said cylindrical member when said flange assembly is mounted to said cylindrical member, wherein said second extensions are projected further outward than said first extensions.

14. A flange assembly according to claim 13, wherein said flange has a side which is opposed to an end surface of said cylindrical member when said flange assembly is mounted to said cylindrical member.

15. A flange according to claim 14, wherein said side is provided with a hole, through which a tool enters when said flange is mounted to said cylindrical member.

16. A flange assembly according to claims 1, 14 or 15, wherein said first extensions and said second extensions are alternately provided, and are extended radially.

17. A flange assembly according to claim 16, wherein said first extension are bent in a free state.

18. A flange assembly according to claim 16, wherein said second extensions are bent in a free state, and said first extensions and said second extensions are bent in different directions.

19. A flange assembly according to claim 13, wherein a plurality of mounting holes are disposed around said hole provided at a center portion of said base plate to fix said mounting member to said flange.

20. A flange assembly according to claim 13, wherein when an electrophotographic photosensitive drum is mounted to a frame of a process cartridge, said hole receives a shaft for rotatably supporting said electrophotographic photosensitive drum on said frame.

21. A flange assembly according to claims 13, 14, 15, or 19, wherein said mounting member includes a metal plate.

22. A flange assembly according to claim 13, wherein said base plate is circular in shape, wherein when an electrophotographic photosensitive drum is mounted to a frame of a process cartridge, said hole receives a shaft for rotatably supporting said electrophotographic photosensitive drum, and said first extensions and said second extensions are alternately provided, wherein said first extensions and said second extensions are radially extended, and wherein said mounting member includes a metal plate.

23. A flange assembly to be mounted to an end of an electrophotographic photosensitive drum, comprising:

a. a flange having an engaging portion for engagement to an end of a cylindrical member of the electrophotographic photosensitive drum, wherein said flange has a side which is opposed to an end surface of said cylindrical member when said flange assembly is mounted to said cylindrical member; and b. a mounting member which is mounted to said flange and which includes:

a base plate;

a hole provided at a center portion of said base plate, wherein when a electrophotographic photosensitive drum is mounted to a frame of a process cartridge, said hole receives a shaft for rotatably supporting said electrophotographic photosensitive drum;

a plurality of first extensions projecting outwardly from an edge of said base plate and elastically contacting an inner surface of said flange;

a plurality of second projected portions projecting outwardly from an edge of said base plate, for elastic contact to an inner surface of said cylindrical member when said flange assembly is mounted to said cylindrical member;

wherein said first and second extensions are alternately provided, and are extended radially, wherein said second extensions project further outward than said first extensions, and wherein said base plate, said first and second extensions are composed of metal.

24. A flange according to claim 23, wherein said side is provided with a hole, through which a tool enters when said flange is mounted to said cylindrical member.

25. A flange according to claim 24, wherein said first projected portions are bent in a free state.

26. A flange according to claim 23, wherein said second projected portion are bent in a free state, and said first projected portions and said second projected portions are bent in different directions.

27. A flange assembly according to claims 23, 24, 25 or 26, wherein a plurality of mounting holes are disposed around said hole provided at the center portion of said base to fix said mounting member to said flange.

28. An electrophotographic photosensitive drum for use with an electrophotographic image forming apparatus, comprising:

a. a cylindrical member having a photosensitive layer on a peripheral surface thereof; and b. a drum flange assembly which is engaged with an end of said cylindrical member and which includes:

a flange having an engaging portion engaged with the end of said cylindrical member;

a mounting member which is mounted to said flange and which includes:

a base plate;

a hole provided at a center portion of said base plate;

a plurality of first extensions projecting outwardly from an edge of said base plate and elastically contacted to an inner surface of said flange;

a plurality of second extensions projecting outwardly from an edge of said base plate and elastically contacted to an inner surface of said cylindrical member, wherein said second extensions project further outward than said first extensions.

29. An electrophotographic photosensitive drum according to claim 28, wherein said electrophotographic photosensitive drum is provided in a process cartridge which is detachably mountable to a main assembly of said electrophotographic image forming apparatus.

30. An electrophotographic photosensitive drum according to claim 28, wherein said flange has a side which is opposed to an end surface of said cylindrical member.

31. An electrophotographic photosensitive drum according to claim 30, wherein said side is provided with a tool hole, through which a tool enters when said drum flange assembly is mounted to said cylindrical member.

32. An electrophotographic photosensitive drum according to claims 28, 29, 30 or 31, wherein said first and second extensions are alternately provided, and are extended radially.

33. An electrophotographic photosensitive drum according to claim 32, wherein said first projected portions are bent in a free state.

34. An electrophotographic photosensitive drum according to claim 32, wherein said second projected portions are bent in a free state, and said first projected portions and said second projected portions are bent in different directions.

35. An electrophotographic photosensitive drum according to claim 28, wherein a plurality of mounting holes are disposed around said hole to fix said mounting member to said flange.

36. An electrophotographic photosensitive drum according to claim 28, wherein when an electrophotographic photosensitive drum is mounted to a frame of a process cartridge, said hole receives a shaft for rotatably supporting said electrophotographic photosensitive drum on said frame.

37. An electrophotographic photosensitive drum according to any one of claims 28, 29, 30, 31, or 35, wherein said mounting member includes a metal plate.

38. An electrophotographic photosensitive drum according to claim 28, wherein said base plate is circular in shape, wherein when an electrophotographic photosensitive drum is mounted to a frame of a process cartridge, said hole receives a shaft for rotatably supporting said electrophotographic photosensitive drum on said frame, and said first and second extensions are alternately provided, wherein said first and second extensions are radially extended and wherein said mounting member includes a metal plate.

39. An electrophotographic photosensitive drum for use with an electrophotographic image forming apparatus, comprising:

a. a cylindrical member having a photosensitive layer on a peripheral surface thereof; and b. a drum flange assembly which is engaged with an end of said cylindrical member and which includes:

a flange having an engaging portion engaged with the end of said cylindrical member of the electrophotographic photosensitive drum, wherein said flange has a side which is opposed to a side surface of said cylindrical member;

a mounting member, which includes:

a substantially circular base plate;

a hole provided at a center portion of said base plate, wherein when an electrophotographic photosensitive drum is mounted to a frame of a process cartridge, said hole receives a shaft for rotatably supporting said electrophotographic photosensitive drum on said frame;

a plurality of first extensions projecting outwardly from an edge of said base plate and elastically contacted to an inner surface of said flange;

a plurality of second extensions projecting outwardly from an edge of said base plate elastically contacted to an inner surface of said cylindrical member;

wherein said first and second extensions are alternately provided, and are extended radially, wherein said second extensions project further outward than said first extensions, and wherein said base plate and said first and second extensions are composed of metal.

40. An electrophotographic photosensitive drum according to claim 39, wherein said side is provided with a hole, through which a tool enters when said flange is mounted to said cylindrical member.

41. An electrophotographic photosensitive drum according to claim 39, wherein said first projected portions are bent in a free state.

42. An electrophotographic photosensitive drum according to claim 40 or 41, wherein said second extensions are bent in a free state, and said first extensions and said second extensions are bent in different directions.

43. An electrophotographic photosensitive drum according to claims 39, 40 or 41, wherein said first extensions are bent in a free state.

44. A process cartridge detachably mountable to a main assembly of an electrophotographic image forming apparatus, comprising:

a. an electrophotographic photosensitive drum which includes:
- a cylindrical member having a photosensitive layer on a peripheral surface thereof; and
- a drum flange assembly which is engaged with an end of said cylindrical member and which includes:
  - flange having an engaging portion engaged with the end of said cylindrical member;
  - a mounting member mounted to said flange, said mounting member including:
    - a base plate;
    - a hole provided at a center portion of said base plate;
    - a plurality of first extensions projecting outwardly from an edge of said base plate and elastically contacted to an inner surface of said flange;
    - a plurality of second extensions projecting outwardly from an edge of said base plate elastically contacted to an inner surface of said cylindrical member wherein said second extensions project further outward than said first extensions; and b. process means actable on said electrophotographic photosensitive drum.

45. A process cartridge according to claim 44, wherein said process means includes at least one of a charging member for electrically charging said electrophotographic photosensitive drum, a developing member for developing a latent image formed on said electrophotographic photosensitive drum and a cleaning member for removing residual toner from said electrophotographic photosensitive drum.

46. A process cartridge according to claim 44, wherein said flange has a side which is opposed to an end surface of said cylindrical member.

47. A process cartridge according to claim 44, wherein said side is provided with a tool hole, through which a tool enters when said flange assembly is mounted to said cylindrical member.

48. A process cartridge according to claims 44, 45, 46 or 47, wherein said first extensions and said second extensions are alternately provided, and are extended radially.

49. A process cartridge according to claim 48, wherein said first projected portions are bent in a free state.

50. A process cartridge according to claim 48, wherein said second extensions are bent in a free state, and said first and second extensions are bent in different directions.

51. A process cartridge according to claim 44, wherein a plurality of mounting holes are disposed around said hole provided at a center portion of said base plate to fix said mounting member to said flange.

52. A process cartridge according to claim 50, wherein said hole receives a shaft for rotatably supporting said electrophotographic photosensitive drum on a frame of said process cartridge.

53. A process cartridge according to claims 44, 45, 46, or 51, wherein said mounting member includes a metal plate.

54. A process cartridge according to claim 50, wherein said first projected portions are bent in a free state.

55. A process cartridge detachably mountable to a main assembly of an electrophotographic image forming apparatus, comprising:

a. an electrophotographic photosensitive drum which includes:
- a cylindrical member having a photosensitive layer on a peripheral surface thereof; and
- a drum flange assembly which is engaged with an end of said cylindrical member and which includes:
  - a flange having an engaging portion engaged with the end of said cylindrical member, wherein said flange has a side which is opposed to a side surface of said cylindrical member;
  - a mounting member which is mounted on said flange, said mounting member including:
    - a substantially circular base plate;
    - a hole provided at a center portion of said base plate, wherein said hole receives a shaft for rotatably supporting said electrophotographic photosensitive drum on a frame of said process cartridge;
    - a plurality of first extensions projecting outwardly from an edge of said base plate and elastically contacted to an inner surface of said flange;
    - a plurality of second extensions projecting outwardly from an edge of said base plate elastically contacted to an inner surface of said cylindrical member;

wherein said first extensions and said second extensions are alternately provided, and are extended radially, wherein said second extensions project further outward than said first extensions, and wherein said base plate, said first extensions and said second extensions are composed of metal;

b. process means actable on said electrophotographic photosensitive drum.

56. A process cartridge according to claim 55, wherein said process means includes at least one of a charging member for electrically charging said electrophotographic photosensitive drum, a developing member for developing a latent image formed on said electrophotographic photosensitive drum and a cleaning member for removing residual toner from said electrophotographic photosensitive drum.

57. A process cartridge according to claim 55, wherein said side is provided with a tool hole, through which a tool enters when said flange assembly is mounted to said cylindrical member.

58. A process cartridge according to claim 55, wherein said first extensions are bent in a free state.

59. A process cartridge according to claim 55 or 56, wherein said second extensions are bent in a free state, and said first extensions and said second extensions are bent in different directions.

60. A process cartridge according to claim 55, wherein a plurality of mounting holes are disposed around said hole provided at a center portion of said base plate to fix said mounting member to said flange.

61. A flange assembly according to claim 13 or 23, wherein between said flange and said mounting member, there is provided a grounding plate for electrically grounding the photosensitive member to the main assembly of the electrophotographic image forming apparatus when the photosensitive drum is mounted to the main assembly.

62. An electrophotographic photosensitive drum, according to claim 28 or 42, wherein between said flange and said mounting member, there is provided a grounding plate for electrically grounding the photosensitive member to the main assembly of the electrophotographic image forming apparatus when the photosensitive drum is mounted to the main assembly.

63. A process cartridge according to claim 44 or 55, wherein between said flange and said mounting member, there is provided a grounding plate for electrically grounding the photosensitive member to the main assembly of the electrophotographic image forming apparatus when said process cartridge is mounted to the main assembly.

64. A flange assembly according to claim 21, wherein between said flange and said mounting member, there is provided a grounding plate for electrically grounding the photosensitive member to the main assembly of the electrophotographic image forming apparatus when the photosensitive drum is mounted to the main assembly.

65. A flange assembly according to claim 27, wherein between said flange and said mounting member, there is provided a grounding plate for electrically grounding the photosensitive member to the main assembly of the electrophotographic image forming apparatus when the photosensitive drum is mounted to the main assembly.

66. An electrophotographic photosensitive drum, according to claim 37, wherein between said flange and said mounting member, there is provided a grounding plate for electrically grounding the photosensitive member to the main assembly of the electrophotographic image forming apparatus when the photosensitive drum is mounted to the main assembly.

67. An electrophotographic photosensitive drum, according to claim 43, wherein between said flange and said mounting member, there is provided a grounding plate for electrically grounding the photosensitive member to the main assembly of the electrophotographic image forming apparatus when the photosensitive drum is mounted to the main assembly.

68. A process cartridge according to claim 58, wherein between said flange and said mounting member, there is provided a grounding plate for electrically grounding the photosensitive member to the main assembly of electrophotographic image forming apparatus when said process cartridge is mounted to the main assembly.

69. A process cartridge according to claim 64, wherein between said flange and said mounting member, there is provided a grounding plate for electrically grounding the photosensitive member to the main assembly of the electrophotographic image forming apparatus when said process cartridge is mounted to the main assembly.

70. A mounting member for mounting a flange to an end of a cylindrical member of an electrophotographic photosensitive drum, comprising:

a circular metal base plate;

a hole provided at a center portion of said base plate, said hole receiving a shaft for rotatably supporting an electrophotographic photosensitive drum when the electrophotographic photosensitive drum is mounted to a frame of a process cartridge;

a plurality of mounting holes disposed around said hole provided at the center portion of said base plate to fix said mounting member to said flange;

a plurality of first extensions provided projected radially outward from an edge of said base plate and bent in a free state, for elastic contact to an inner surface of said flange when said mounting member is mounted to the flange;

a plurality of second extensions provided projected from an edge of said base plate radially outward more than the first extensions and bent in a free state in a different direction than the first extensions, for elastic contact to an inner surface of said cylindrical member when said flange is mounted to said cylindrical member, wherein said first extensions and said second extensions are alternately provided.

71. An electrophotographic photosensitive drum for use with an electrophotographic image forming apparatus, comprising:

a. a cylindrical member having a photosensitive layer on a peripheral surface thereof; and b. a drum flange assembly which is engaged with an end of said cylindrical member and which includes:

a flange having an engaging portion engaged with the end of said cylindrical member of the electrophotographic photosensitive drum, wherein said flange has a side which is opposed to an end surface of said cylindrical member and is provided with a hole, through which a tool enters when said flange assembly is mounted to said cylindrical member;

a mounting member, which includes:

a substantially circular metal base plate;

a hole provided at a center portion of said base plate, wherein when an electrophotographic photosensitive drum is mounted to a frame of a process cartridge, said hole receives a shaft for rotatably supporting said electrophotographic photosensitive drum;

a plurality of mounting holes disposed around said hole provided at the center portion of said base plate to fix said mounting member to said flange;

a plurality of first extensions bent in a free state, provided projected outwardly from an edge of said base plate and elastically contacted to an inner surface of said flange; and a plurality of second extensions bent in a free state in a different direction than the first extensions, projecting outwardly from an edge of said base plate and elastically contacted to an inner surface of said cylindrical member, wherein said first and second extensions are alternately provided, and are extended radially, wherein said second extensions project further outward than said first extensions, and wherein said base plate, and said first and second extensions are composed of metal.

72. A process cartridge detachably mountable to a main assembly of an electrophotographic image forming apparatus, comprising:

a. an electrophotographic photosensitive drum which includes:

a cylindrical member having a photosensitive layer on a peripheral surface thereof; and a drum flange assembly which is engaged with an end of said cylindrical member and which includes:

a flange having an engaging portion engaged with the end of said cylindrical member, wherein said flange has a side provided with a hole through which a tool enters when said flange assembly is mounted to said cylindrical member, said side being opposed to an end surface of said cylindrical member;

a mounting member which is engaged with an end of said cylindrical member and which includes:

a substantially circular base plate;

a hole provided at a center portion of said base plate, wherein said hole receives a shaft for rotatably supporting said electrophotographic photosensitive drum on a cartridge frame;

a plurality of mounting holes disposed around said hole provided at a center portion of said base plate to fix said mounting member to said flange;

a plurality of first extensions bent in a free state, projecting outwardly from an edge of said base plate and elastically contacted to an inner surface of said flange;

a plurality of second extensions bent in a free state in a different direction than the first extensions, projecting outwardly from an edge of said base plate elastically contacted to an inner surface of said cylindrical member;

wherein said first and second extensions are alternately provided, and are extended radially, wherein said second extensions project further outward than said first extensions, and wherein said base plate, and said first and second extensions are composed of metal; and b. process means actable on said electrophotographic photosensitive drum including at least one of a charging member for electrically charging said electrophotographic photosensitive drum a developing member for developing a latent image formed on said electrophotographic photosensitive drum and a cleaning member for removing residual toner from said electrophotographic photosensitive drum.

73. A mounting member according to claims 1, 9 or 70, wherein said flange is mounted on said cylindrical member by pressure and an elastic force provided by said second extensions.

74. A flange assembly according to claim 13 or 23, wherein said flange is mounted on said cylindrical member by pressure and an elastic force provided by said second extensions.

75. An electrophotographic photosensitive drum according to claims 28, 39 or 71, wherein said cylindrical member has said flange mounted thereon by pressure and an elastic force provided by said second extensions.

76. A process cartridge according to claims 34, 55 or 72, wherein said cylindrical member has said flange mounted thereon by pressure and an elastic force provided by said second extensions.

* * * * *

UNITED STATES PATENT AND TRADEMARK OFFICE

CERTIFICATE OF CORRECTION

PATENT NO. : 6,336,017 B1
DATED : January 1, 2002
INVENTOR(S) : Jun Miyamoto et al.

It is certified that error appears in the above-identified patent and that said Letters Patent is hereby corrected as shown below:

Column 3,
Line 40, “B.” should read -- B --.
Line 42, “fit” should read -- fits --.

Column 4,
Line 32, “R1” should read -- K1 --.
Line 46, “latent, image” should read -- latent image, --.

Column 5,
Line 2, “in” should read -- In --.
Line 19, “drum .7.” should read -- drum 7. --.

Column 7,
Line 56, “Lcontact” should read -- contact --.

Column 8,
Line 31, “the 701” should read -- portion 701 --.

Column 9,
Line 39, “go Here, an” should read -- ¶ Here, a --.

Column 10,
Line 9, “Referential” should read -- Reference --.

Column 11,
Line 13, “b52” should read -- D52 --.
Line 66, “symmetrically” should read -- symmetry --.

Column 16,
Line 14, “Sphosphor” should read -- phosphor --.
Line 20, “pawl-as” should read -- as --.

Column 18,
Line 8, “contacts” should read -- contact --.
Line 45, “longitudinally” should read -- longitudinal --.

Column 21,
Line 43, “a” should read -- an --.

UNITED STATES PATENT AND TRADEMARK OFFICE

CERTIFICATE OF CORRECTION

PATENT NO. : 6,336,017 B1
DATED : January 1, 2002
INVENTOR(S) : Jun Miyamoto et al.

It is certified that error appears in the above-identified patent and that said Letters Patent is hereby corrected as shown below:

Column 22,
Line 32, “extension” should read -- extensions --.

Column 23,
Line 25, “portion” should read -- portions --.

Column 26,
Line 67, “42” should read -- 39 --.

Column 27,
Line 36, “58” should read -- 53 --.

Column 30,
Line 1, “drum” should read -- drum --.

Signed and Sealed this

Seventh Day of January, 2003

JAMES E. ROGAN
*Director of the United States Patent and Trademark Office*